US007756613B2

(12) United States Patent
Katsuta et al.

(10) Patent No.: US 7,756,613 B2
(45) Date of Patent: Jul. 13, 2010

(54) SIGNALING SYSTEM

(75) Inventors: Keiichi Katsuta, Hitachi (JP); Yoichi Sugita, Naka (JP); Dai Watanabe, Hitachi (JP); Takashi Yamaguchi, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 42 days.

(21) Appl. No.: 11/354,159

(22) Filed: Feb. 15, 2006

(65) Prior Publication Data

US 2006/0195236 A1 Aug. 31, 2006

(30) Foreign Application Priority Data

Feb. 25, 2005 (JP) ..... 2005-049921

(51) Int. Cl.
*B61L 3/00* (2006.01)
*B61L 3/22* (2006.01)
*B61L 21/08* (2006.01)

(52) U.S. Cl. ..... 701/19; 701/20; 246/3; 246/7; 246/14; 246/20; 246/27

(58) Field of Classification Search ..... 180/14.1; 105/27; 246/124
See application file for complete search history.

(56) References Cited

U.S. PATENT DOCUMENTS 3,284,627 A * 11/1966 Wilcox ..... 246/187 B
3,402,289 A * 9/1968 Burke et al. ..... 246/167 R
3,794,833 A * 2/1974 Blazek et al. ..... 246/63 C
4,046,342 A * 9/1977 Buzzard ..... 246/34 R
4,711,418 A * 12/1987 Aver et al. ..... 246/5
4,735,383 A * 4/1988 Corrie ..... 246/3
4,994,969 A * 2/1991 Petit ..... 701/19
5,340,062 A * 8/1994 Heggestad ..... 246/5
5,398,894 A * 3/1995 Pascoe ..... 246/28 R
5,437,422 A * 8/1995 Newman ..... 246/5

(Continued)

FOREIGN PATENT DOCUMENTS

DE 44 06 720 A1 8/1995

(Continued)

OTHER PUBLICATIONS

Fay, A., "Dezentrale Steuerung des Schienenverkehrs durch autonome Agenten", Signal & Draft, Mar. 2000, pp. 14-18, vol. 92, Telzlaff Verlag, Hamburg. (XP-002262020).

(Continued)

*Primary Examiner*—Jack Keith
*Assistant Examiner*—Jonathan M Dager
(74) *Attorney, Agent, or Firm*—Crowell & Moring, LLP

(57) ABSTRACT

Trains and points are patrolled by a telegram containing the block occupancy information as a section that only one train is permitted to occupy, the information for giving lock position instructions to a point, and the point position information. This telegram is updated in order to get the right of block occupancy that is not held by other trains, and to give lock position instruction to the point. The train checks the block which this train is allowed to occupy, confirms that the point in this block has been set to the lock position specified by this train. Reading the aforementioned telegram, the point checks the lock position instruction given to itself and controls its lock position. A signaling system characterized by reduced designing and manufacturing costs is provided.

13 Claims, 31 Drawing Sheets

U.S. PATENT DOCUMENTS

| | | | | |
|---|---|---|---|---|
| 5,533,695 | A * | 7/1996 | Heggestad et al. | 246/62 |
| 5,751,569 | A * | 5/1998 | Metel et al. | 700/3 |
| 5,950,966 | A * | 9/1999 | Hungate et al. | 246/62 |
| 5,995,881 | A * | 11/1999 | Kull | 701/20 |
| 6,135,396 | A * | 10/2000 | Whitfield et al. | 246/182 R |
| 6,459,965 | B1 * | 10/2002 | Polivka et al. | 701/19 |
| 6,604,031 | B2 * | 8/2003 | Oguma et al. | 701/19 |
| 6,631,873 | B2 * | 10/2003 | Fisher | 246/182 B |
| 6,666,411 | B1 * | 12/2003 | Hart et al. | 246/62 |
| 6,679,459 | B2 * | 1/2004 | Kaiser | 246/182 C |
| 6,694,231 | B1 * | 2/2004 | Rezk | 701/19 |
| 6,845,953 | B2 * | 1/2005 | Kane et al. | 246/20 |
| 7,182,298 | B2 * | 2/2007 | Fischer | 246/167 R |
| 7,209,811 | B1 * | 4/2007 | Goricke et al. | 701/19 |
| 2003/0052233 | A1 * | 3/2003 | Frick | 246/194 |
| 2003/0105560 | A1 * | 6/2003 | Sugita et al. | 701/19 |
| 2003/0222180 | A1 * | 12/2003 | Hart et al. | 246/167 R |
| 2004/0006411 | A1 * | 1/2004 | Kane et al. | 701/1 |
| 2004/0059442 | A1 * | 3/2004 | Birkelbach et al. | 700/30 |
| 2004/0182970 | A1 * | 9/2004 | Mollet et al. | 246/473 R |
| 2004/0267415 | A1 * | 12/2004 | Lacote et al. | 701/19 |
| 2005/0001741 | A1 * | 1/2005 | Taoka et al. | 340/933 |
| 2005/0061923 | A1 * | 3/2005 | Kane et al. | 246/167 R |
| 2005/0137760 | A1 * | 6/2005 | Watanabe et al. | 701/19 |

FOREIGN PATENT DOCUMENTS

| | | | |
|---|---|---|---|
| DE | 44 21 821 | A1 | 1/1996 |
| EP | 1 147 966 | A1 | 10/2001 |
| JP | 7-41840 | B2 | 5/1995 |
| JP | 2004-133585 | A | 4/2004 |

OTHER PUBLICATIONS

Lege, B., "Regelung des Selbsttaetig Signalgefuehrten Triebfahrzeugs SST mit paralleler Programmverarbeltung", Zeitschrift Fur Eisenbahnwesen Und Verkehrstechnlk. Die Eisenbahntechnik & Glasers Annalen, Jul. 1997, pp. 388-395, vol. 121, No. 7, George Siemens Verlagsbuchhandlung. Berlin, DE. (XP 000693548).

Extended European Search Report dated Jun. 9, 2006 (Eight (8) pages).

Fay, A., "Dezentrale Steuerung des Schienenverkehrs durch autonome Agenten", Signal & Draft, Mar. 2000, pp. 14-18, vol. 92, Telztaff Verlag, Hamburg. (XP-002262020), English Translation: Fay, A., "Decontralised control of train traffic by autonomous agents", Signal & Draft, Mar. 2000, vol. 92, pp. 1-8, Tetzlaff Verlag, Hamburg. (XP—002262020).

Lege, B., "Regelung des Selbsttaetig Signalgefuehrten Triebfahrzeugs SST mit paralleler Programmverarbeitung", Zeitschrift Fur Eisenbahnwesen Und Verkehrstechnik. Die Elsenbahntechnik & Glasers Annalen, Jul. 1997, pp. 388-395, vol. 121, No. 7, George Siemens Verlagsbuchhandlung. Berlin, DE. (XP 000693548), English Translation: Lege, B., "SST, the automatically signal-controlled traction vehicle with parallel processing programmes", ZEV & DET Glasers Annalen, Jul. 1997, vol. 121, No. 7, pp. 1-2, Georg Siemens. (XP-000693548).

* cited by examiner

| BLOCK OCCUPANCY COLUMN | | | | | | | | | | | |
|---|---|---|---|---|---|---|---|---|---|---|---|
| 1 | 2 | 3 | 4 | 5 | 6 | 7 | 8 | 9 | 10 | 11 | |
| | | | | | | | | | | | |

| POINT LOCK POSITION INSTRUCTION COLUMN | | |
|---|---|---|
| 1 | 2 | 3 |
| | | |

| POINT POSITION STATUS COLUMN | | |
|---|---|---|
| 1 | 2 | 3 |
| NORMAL POSITION | NORMAL POSITION | NORMAL POSITION |

| MEMBER LIST | | | | | | | | | | | | | |
|---|---|---|---|---|---|---|---|---|---|---|---|---|---|
| 1 | 2 | 3 | 4 | 5 | 6 | 7 | 8 | 9 | 10 | 11 | 12 | 13 | 14 |
| POINT -1 | POINT -2 | POINT -3 | | | | | | | | | | | |

SIGNALING SYSTEM

CLAIM OF PRIORITY

The present application claims priority from Japanese application serial no. 2005-049921, filed on Feb. 25, 2005, the content of which is hereby incorporated by reference into this application.

FIELD OF THE INVENTION

The present invention relates to signaling for traffic control of a vehicle such as a railway, monorail, LRT (Light Rail Transit), AGT (Automated Guided Train) and cars.

BACKGROUND OF THE INVENTION

A signaling system has been developed in the field of railway industry. This system uses an interlocking device as a core of the protection system wherein a track circuit for detecting the train occupied position, a point device used for operation and locking of the point and a signal device for turning on the signal lamp to notify the operator of the permission or non-permission of entry of the train are interlocked to ensure that the train is prevented from entering the route where collision or derailment may occur.

As disclosed in Official Gazette of Japanese Patent hei 7 (1995)-41840, a technique has been developed in recent years, wherein the train position detected by an on-train apparatus is captured by radio, and the point device and signal device installed in the train are interlocked and controlled, based on this train position.

According to another technique having been disclosed in Japanese Patent Laid-open No. 2004-133585, the information on the position of a train is sent to other trains by radio, and the train is controlled, based on the position information sent by radio from other trains.

SUMMARY OF INVENTION

In the track circuit, a rail is subjected to electrical insulation, and a power source is connected to one side, while a relay is connected to the other side, whereby a short circuit between rails caused by a train is detected. The problem with this arrangement is found in the high maintenance cost. An interlocking device is provided with the input/output device for working with the wayside equipment including all track circuit devices, all point devices and all signal devices. Said devices are interlocked to avoid possible collision with the train or derailment. In this track circuit, the logic for providing such control operations is built in the relays and electronic computers. The problem with this method lies in a high cost in designing and manufacturing this track circuit, and a high cost in manufacturing and installing the wiring used for connection between the track circuit and wayside equipment.

In the technique developed in recent years, the control apparatus of the wayside equipment is required to contain a communication means for acquiring the position information from a train, and a logic section and input/output means for providing control under interlock between the point device and signal device to avoid possible collision or derailment of the train, based on the position information from the train. This arrangement increases the cost of designing and manufacturing the apparatus and the base station for relaying the communication between the apparatus and train.

The aforementioned problems are found not only in the rolling stock, but also in the automobiles traveling along the predetermined route.

The object of the present invention is to provide a signaling system characterized by reduced designing and manufacturing costs.

The present invention provides a signaling system wherein the protection of a train traveling within a predetermined section is ensured by a telegram, and the telegram patrols a train or wayside equipment located within the predetermined section and has a block occupancy information for assigning the right of being occupied by a train to each of the blocks formed of a plurality of divisions of the aforementioned section. Further, this telegram has the member list information represented in the order of patrol of the identification information of the train and wayside equipment.

The present invention provides a train comprising:

a traffic control section for storing the operation planning information of a train and for generating the route request information for requesting permission for the train to enter the route, based on the operation planning information;

a train protection section capable of generating a telegram, determining, based on this telegram, whether or not permission to enter should be granted to the aforementioned train, and exchanging the aforementioned telegram with other trains or wayside equipment;

a speed control section for controlling the train travel;

wherein the aforementioned telegram patrols a train and wayside equipment located within a predetermined section and within the section adjacent thereto; and contains:

block occupancy information for assigning the right of being occupied by a train to each of the blocks formed of a plurality of divisions of the aforementioned section; and member list information represented in the order of patrol of the identification information of the train and wayside equipment;

wherein, based on the route request information from the traffic control section and the telegram received from another train or wayside equipment, the aforementioned train protection section determines whether or not permission to enter should be granted to the aforementioned train, sends the updated telegram with other another train or wayside equipment, and outputs the result of decision to the aforementioned train control section.

The present invention provides a point protection apparatus provided with:

a communication section for exchanging the telegram containing:

point lock position information, patrolling the train and point located within a predetermined section and within the section adjacent thereto, including instruction information used for a train to specify the point lock position;

point position information containing the information on point position;

a control section having:

a function for controlling the lock position of the point, based on the point position information of the aforementioned telegram received by the aforementioned communication section; and a function for detecting the position information from the point and updating the point position information in the telegram based on the detected position information.

The present invention provides a signaling system characterized by reduced designing and manufacturing costs.

DESCRIPTION OF THE PREFERRED EMBODIMENTS

Figure 1:
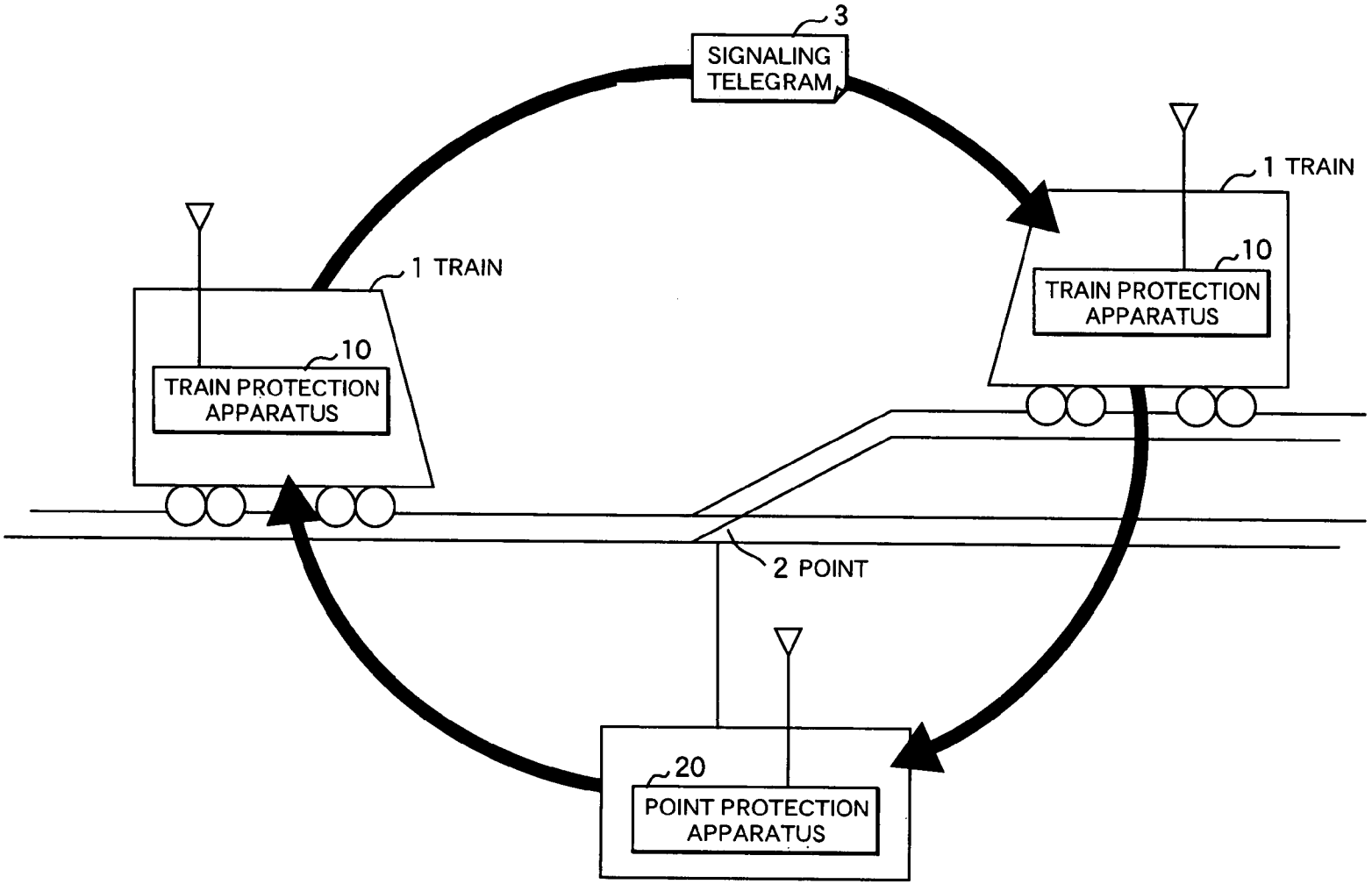
FIG. 1 is a drawing representing a signaling system as an embodiment of the present invention.

FIG. 1 shows the structure of a signaling system as an embodiment of the present invention.

The signaling system of the present invention is assumed to be made up of a train protection apparatus 10 installed on a train 1, a point protection apparatus 20 installed or connected to a point 2, and a signaling telegram 3 as a telegram patrolling between the train protection apparatus and a point protection apparatus 20. As shown in FIG. 1, a plurality of trains 1 are located on the route. The telegram is made to patrol such trains 1 and points 2, thereby providing a signaling system characterized by reduced designing and manufacturing costs.

In the present embodiment, only the point is shown as wayside equipment. Another arrangement can be formed in such a manner that this telegram patrols other wayside equipment such as a track circuit for detecting the train position and a signal apparatus. The system in the present embodiment ensures protection even if there is no signal apparatus. When the signal apparatus is provided and the telegram is used to patrol the signal apparatus, a signaling system characterized by greater visibility will be provided.

Figure 2:
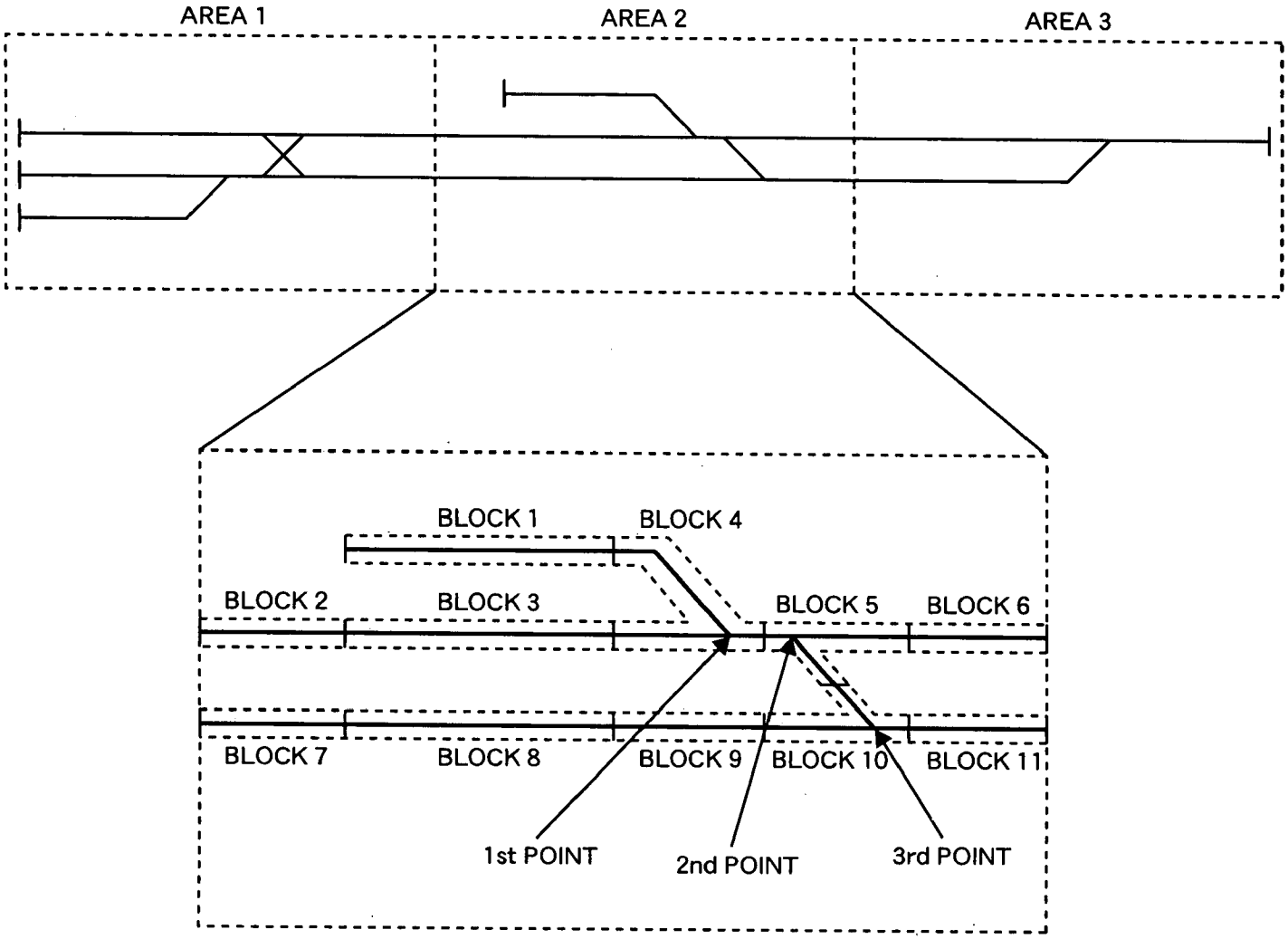
FIG. 2 is a diagram representing the scope of an area and section of a block in the present invention.

As shown in FIG. 2, in the present embodiment the route where the train runs is divided into a plurality of areas (sections). To be more specific, the entire line is divided into predetermined sections. The space of the area is sufficient if the train going to enter the area is capable of communicating with the train or point present in the area. The space of the area can be increased by improving the communication capability of the protection apparatus or installing a relay apparatus. It goes without saying that the entire line can be handled as one area if communication can be made with all the trains located anywhere in the line.

One area is divided into the unit that can be occupied by only one train. The divided section will be called the block. The block can be set as desired. As each block is made smaller, the amount of communication among protection apparatuses will increase. In FIG. 2, the area 2 is divided into eleven blocks. In this case, as shown in FIG. 2, a point is located in some blocks, but not in others.

Thirdly, a unit is determined, and according to this unit, the signaling system of the present embodiment grants permission of traveling to the train. This unit will be called the route. The route is composed of blocks. As each block is made smaller, the amount of communication among protection apparatuses will increase. This will allow more compact train scheduling.

Figure 3:
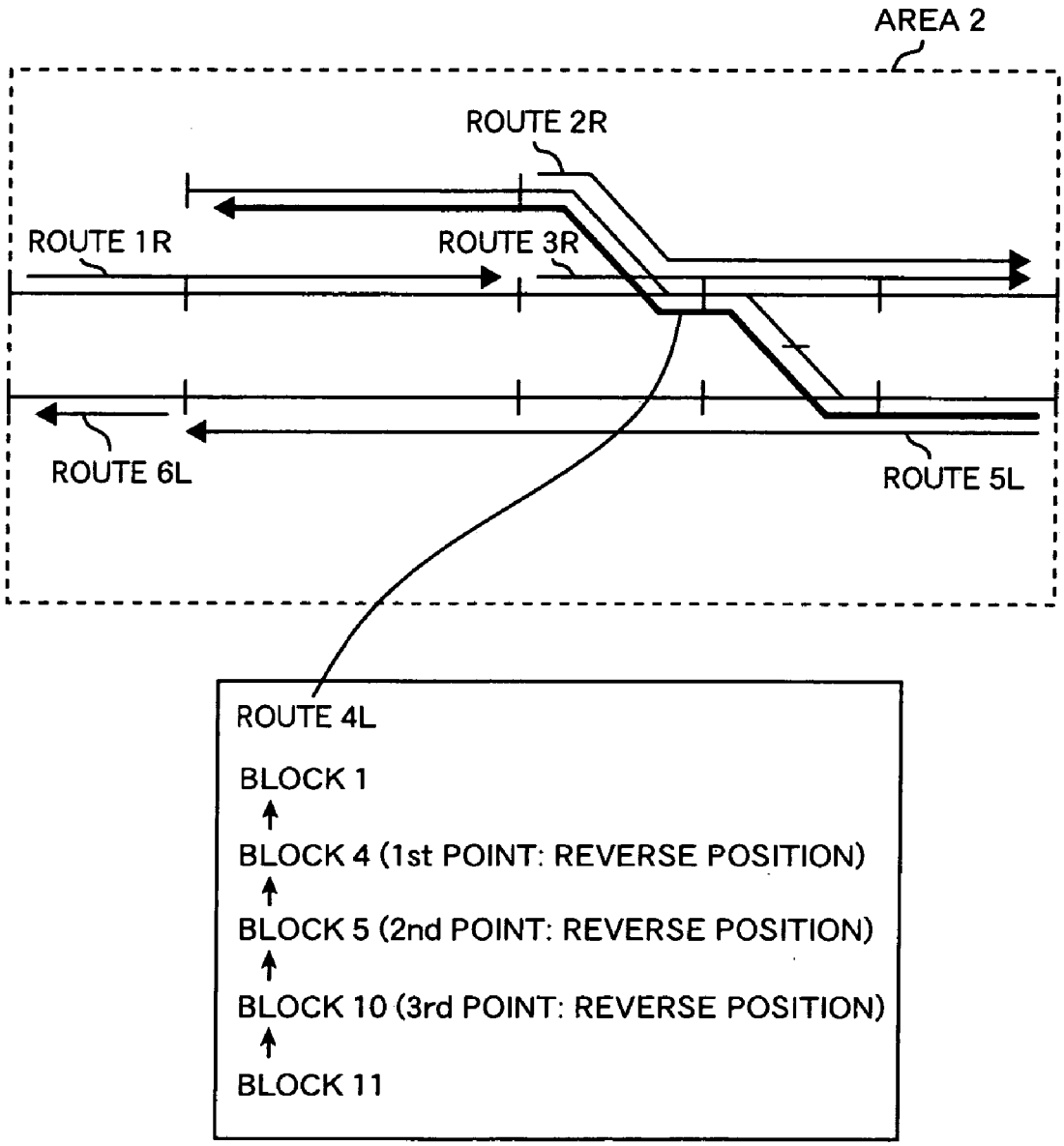
FIG. 3 is a drawing representation each block on the route in the present invention and the lock position of the point.

FIG. 3 is a drawing representing the train route when the area 2 is divided into eleven blocks, as shown in FIG. 2. In this embodiment, FIG. 3 shows the case where routes 1R, 2R, 3R, 4L and 5L are present. The route 4L is composed of five blocks—a blocks 11, a block 10 having a third point, a block 5 having a second point, a block 4 having a first point, and a block 1, wherein each of these points are connected by being locked in the reverse position. In the signaling system of the present invention, the right of occupying all the blocks 11, 10, 5, 4 and 1 is held by one train. When it has been confirmed that the lock positions of the points on each block are in the direction where the block of 4L is connected, the train is granted the right to enter the route 4L. Terms "normal position", "reverse position" and "free position" are used to denote the positions of the point. The normal position denotes the normal position of the point when opening the route. The reverse position is the opposite of the normal position. The free position refers to neither the normal nor reverse position.

In the present invention, the right of block occupancy is granted to each of the blocks in the area so that each block can be occupied by only one train, and a telegram for controlling the right of block occupancy is used to patrol the trains, whereby each train can identifies the current right of block occupancy.

This arrangement ensures that the train having received a telegram can find out the block whose right of occupancy is held by other trains. Further, this arrangement allows the train to update the telegram having received, in such a way that the train can acquire the right to occupy the block whose right of occupancy is not held by other trains. This train is assured that there is no other train in the block whose right of occupancy has been held, and any other train will not enter that block. In this manner, the signaling system of the present invention provides exclusive control of the train. Further, safety is ensured only the patrol by a telegram. This arrangement eliminates the requirements for the cost of manufacturing and installing the cables connecting between the apparatus and the wayside equipment, and provides a very inexpensive signaling system.

In the present embodiment, the right of occupying all the blocks in one area, the lock position instruction for all the points, and the position status for all the points are controlled by one signaling telegram 3. The signaling telegram 3 is made to patrol all the trains currently located in the area, all the trains coming into the area, and all the points in the area. It goes without saying that a plurality of signaling telegram can be used for this control if possible overlaps among control items can be avoided.

Figure 4:
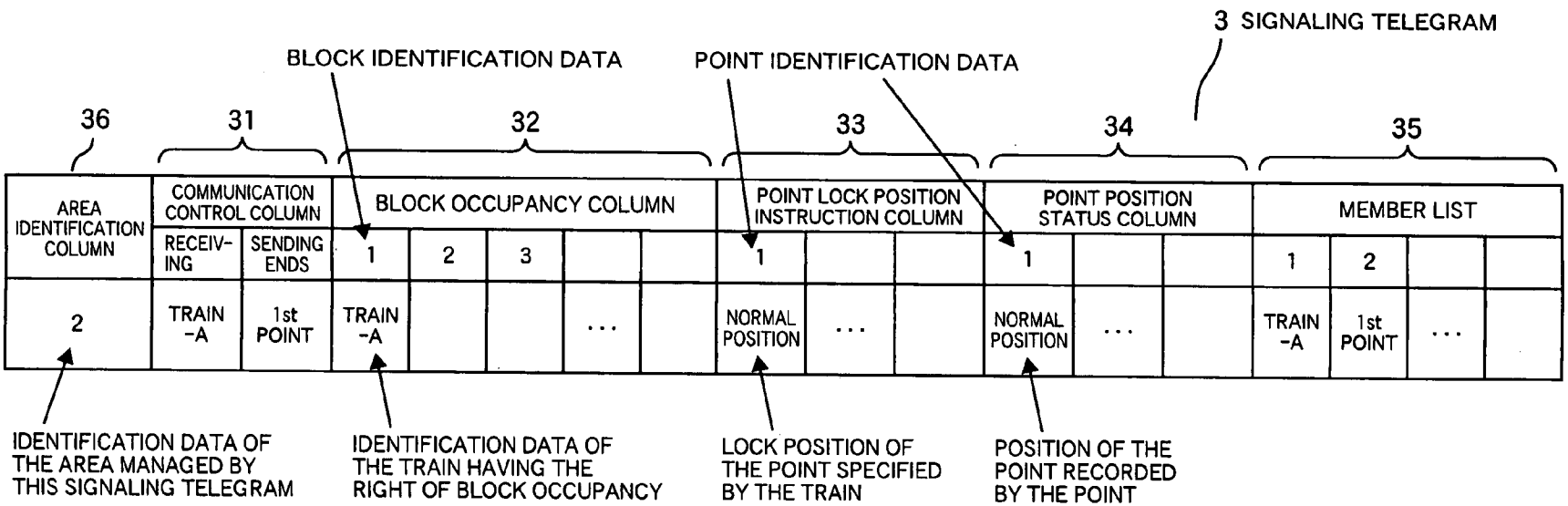
FIG. 4 is a diagram showing an embodiment of the signaling telegram in the signaling system of FIG. 1.

The following describes an embodiment of the signaling telegram with reference to FIG. 4.

In the present embodiment, the signaling telegram 3 is composed of:

an area identification column 36 containing the area identification data, a communication control column 31 containing the information of the receiving end and sending end, a block occupancy column 32 containing the block occupancy information, a point lock position instruction column 33 containing the point lock position instruction information, a point position status column 34 containing the point position status information, and a member list 35 containing the member list information used for the telegram patrol, as shown in FIG. 4.

It should be noted, however, that the composition of the signaling telegram 3 is not restricted to the aforementioned one. If the signaling telegram 3 is capable of controlling the right of block occupancy, exclusive control of the train on the route can be provided. If a means for instructing the position to the point, and a means for allowing the train to identify the point position are separately provided, early instruction of the lock position can be given to the point, and early identification of the lock position of the point can be ensured.

The area identification column 36 includes the identification data of the area under the control of the signaling telegram.

The communication control column 31 contains the information on the receiving end and sending end of the signaling telegram.

The member list 35 contains the identification data for the trains and wayside equipment to be patrolled by the signaling telegram, and these identification data sets are arranged in the order in which they are sent for patrol. The members to be patrolled by the telegram include all the trains currently located in the area, all the trains coming into the area, and all the points in the area. Control of the member list by the signaling telegram per se allows the members to identify the order of the members patrolled by the signaling telegram, upon receipt of the telegram.

The block occupancy column 32 includes the identification data of the train holding the right of block occupancy. The right of block occupancy is what must be acquired before a train enters the block. Only one right of block occupancy is assigned to each block. Only when there is no data input by other train, the identification data of a particular train can be inputted, so that the right of block occupancy is obtained. As described above, the signaling telegram controls the information on the right of block occupancy. To be more specific, the telegram contains the information on the right of block occupancy by the train located in one of the blocks formed in multiple numbers by division of the area, whereby exclusive control of the trains is provided in terms of blocks.

The instruction information for the point lock position is inputted into the point lock position instruction column 33 by the train holding the right of occupying the block where a point is located. The point device locks in the instructed position in conformance to this instruction. As described above, the signaling telegram contains the lock position instruction to the point, thereby allowing the train to control the lock position of the point.

The point position information is inputted into the point position status column 34 by the point device. By checking the position column, the train identifies the position of the point showing the direction of clear route. In this manner, the signaling telegram contains information on the point position status. This arrangement allows the train identify the lock position of the point, upon receipt of the telegram.

The following describes the mechanism of how safety is ensured during the operation of the train by the signaling system of the present invention, with reference to the case where the trains A and B enter the area 2 shown in FIG. 2 by using FIG. 5 to FIG. 15. For each position, the behavior of the train is shown in the top portion of the diagram, and the block occupancy right column of the telegram, the point lock position instruction column, the point position instruction column, and the member list information are shown in the bottom portion.

Figure 5:
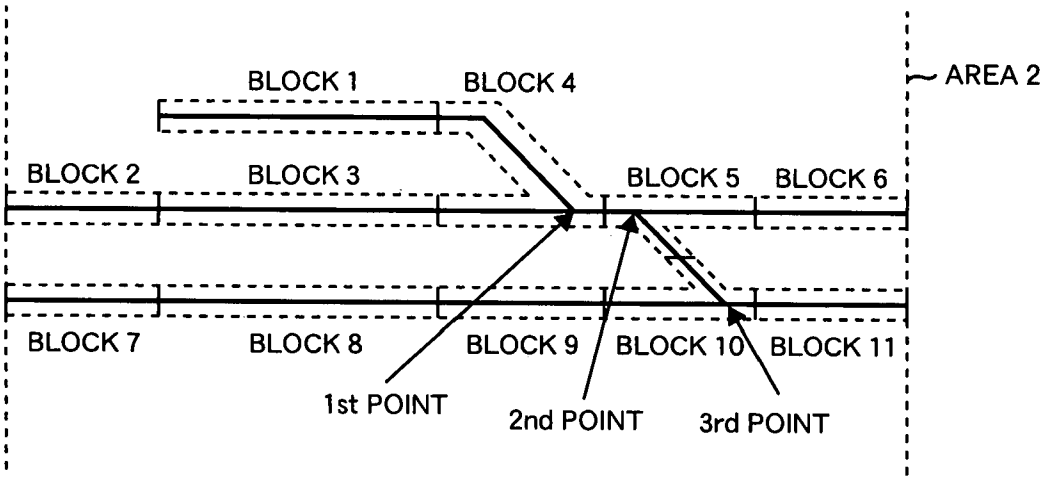
FIG. 5 is a diagram showing the mechanism of ensuring safety at the time of train operation according to the present invention.

State 1: When there is no train located in the area or train going to enter the area, namely, when there is no input in the block occupancy column of the telegram, and there is no train identification data in the member list, the telegram patrols all the point devices within the area described in the member list (FIG. 5).

Figure 6:
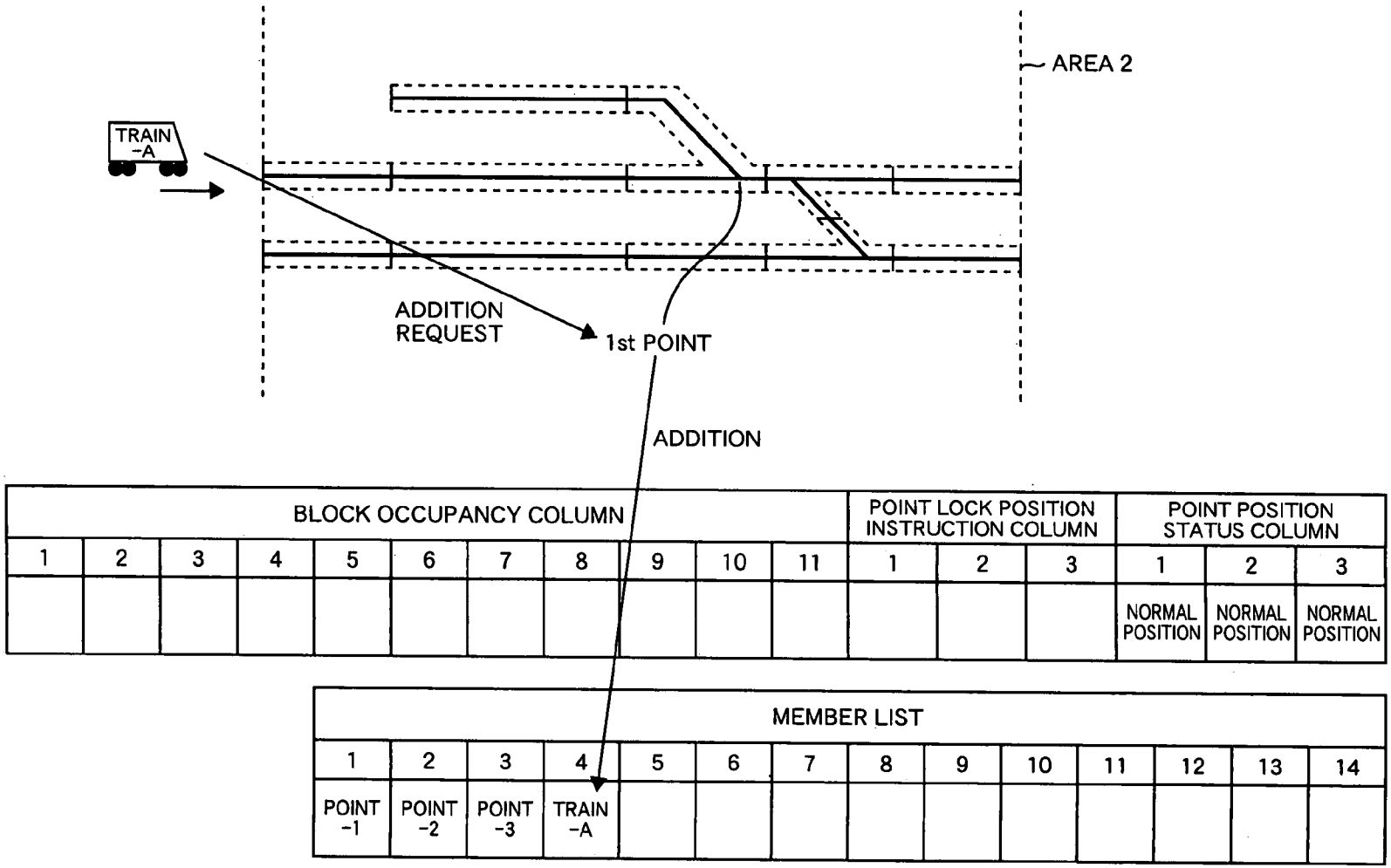
FIG. 6 is a diagram showing the mechanism of ensuring safety at the time of train operation according to the present invention.

State 2: When the train A is going to enter the area 2, the train protection apparatus sends an addition request telegram to the members that may hold the telegram of that area, this addition request telegram containing a request for transmission of the identification data of that train to the member of the telegram. The members that may hold the telegram of that area include the trains that may run in the area (trains located in the area and trains going to enter that area) and the point devices installed within the area. The addition request telegram is the telegram requesting the members of the telegram to add the identification data of its own train (train A) into the member list. It includes the train identification data and the area identification data controlled by the telegram. Of the members having received the addition request telegram, those holding the telegram of that area add the identification data of the train A as a sending end (FIG. 6).

Figure 7:
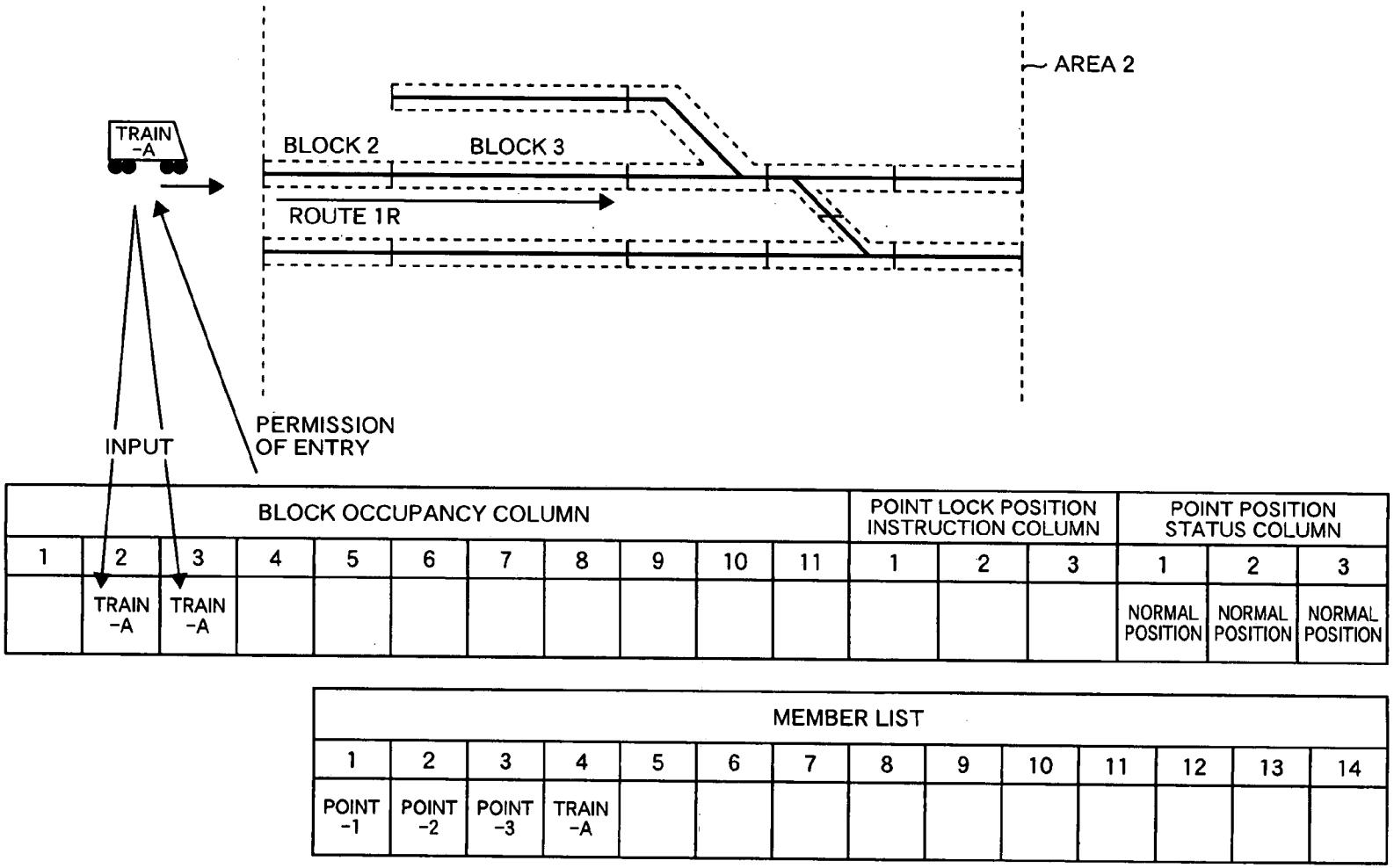
FIG. 7 is a diagram showing the mechanism of ensuring safety at the time of train operation according to the present invention.
Figure 8:
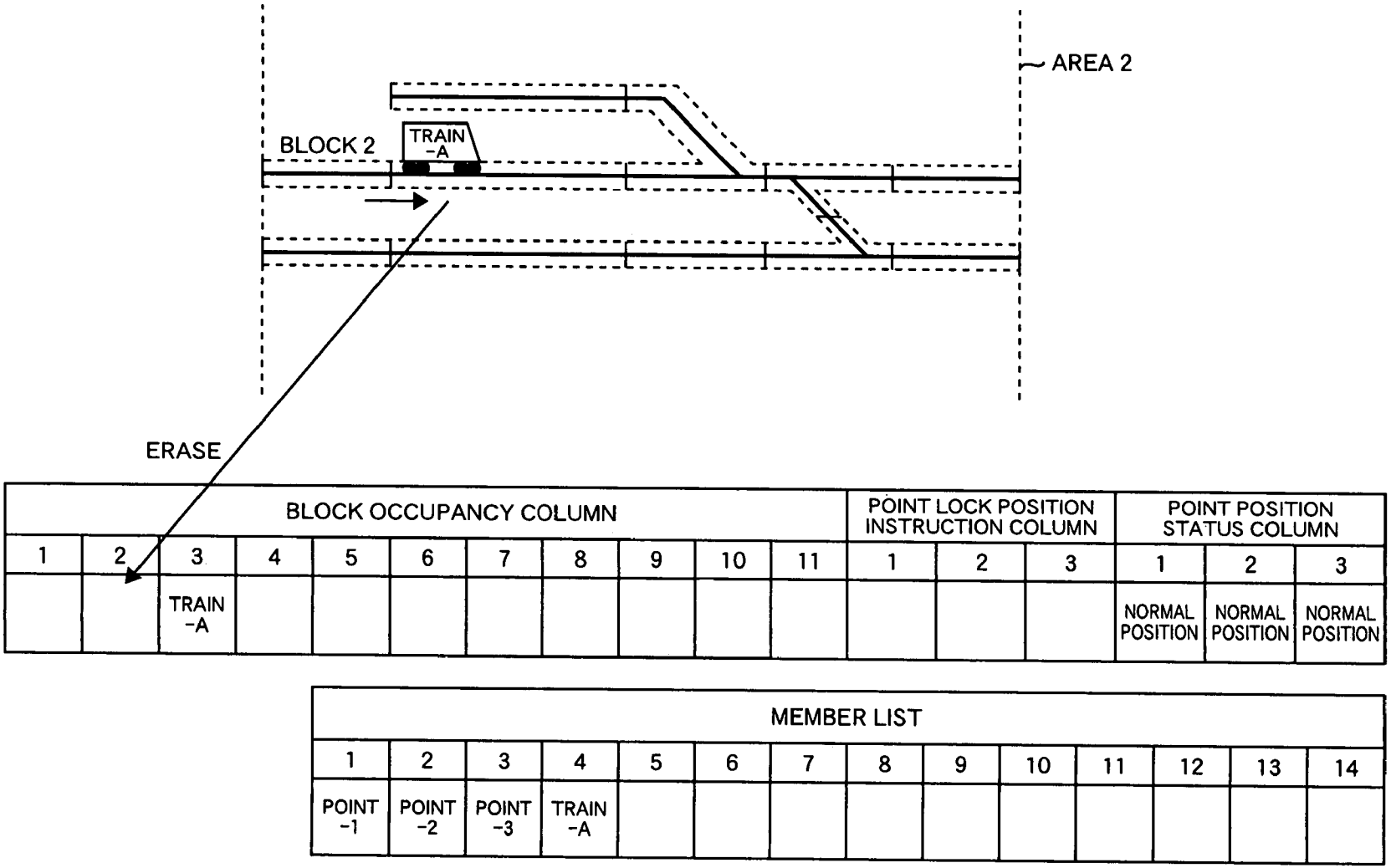
FIG. 8 is a diagram showing the mechanism of ensuring safety at the time of train operation according to the present invention.

State 3: When the signaling telegram has reached the train A according to the order of the member list, the train A identifies the occupancy column 32 for blocks 2 and 3 as components of the requested route 1R. Since the occupancy column 32 for blocks 2 and 3 does not include identification data of other trains, the train A inputs its own identification data in order to get the right of occupying that block, and sends the signaling telegram to the next member. For the route 1R without any point thereon, when the right of occupying all the blocks on the route has been acquired, the train protection section sends the permission to enter the route, to the driver's cab of the train A (FIG. 7).

State 4: After the trailing end of the train A has left the block 2, the train A erases the identification data of its own described in the block occupancy column upon receipt of the signaling telegram. Then the train A sends the signaling telegram to the next member given in the member list.

Figure 9:
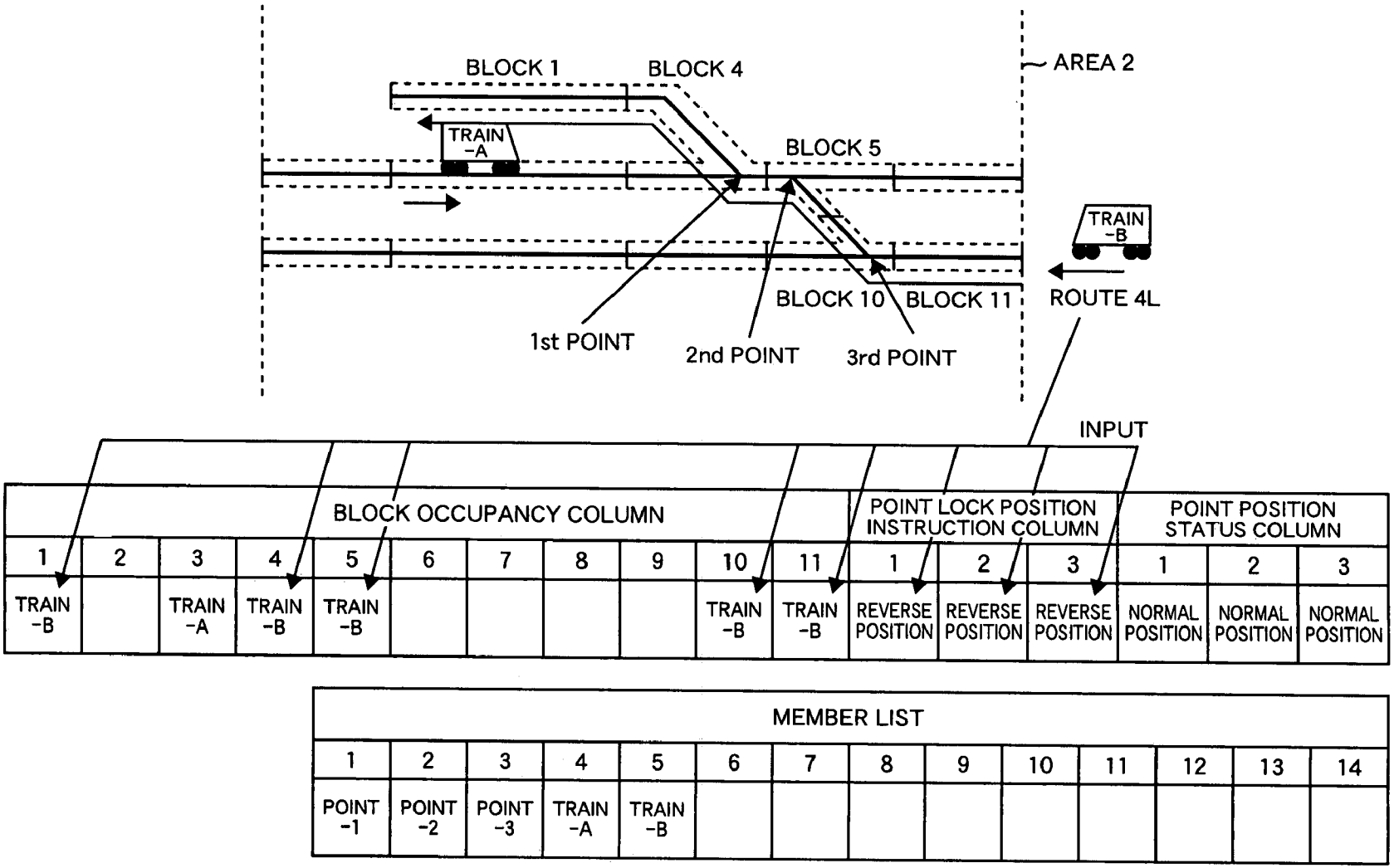
FIG. 9 is a diagram showing the mechanism of ensuring safety at the time of train operation according to the present invention.
Figure 10:
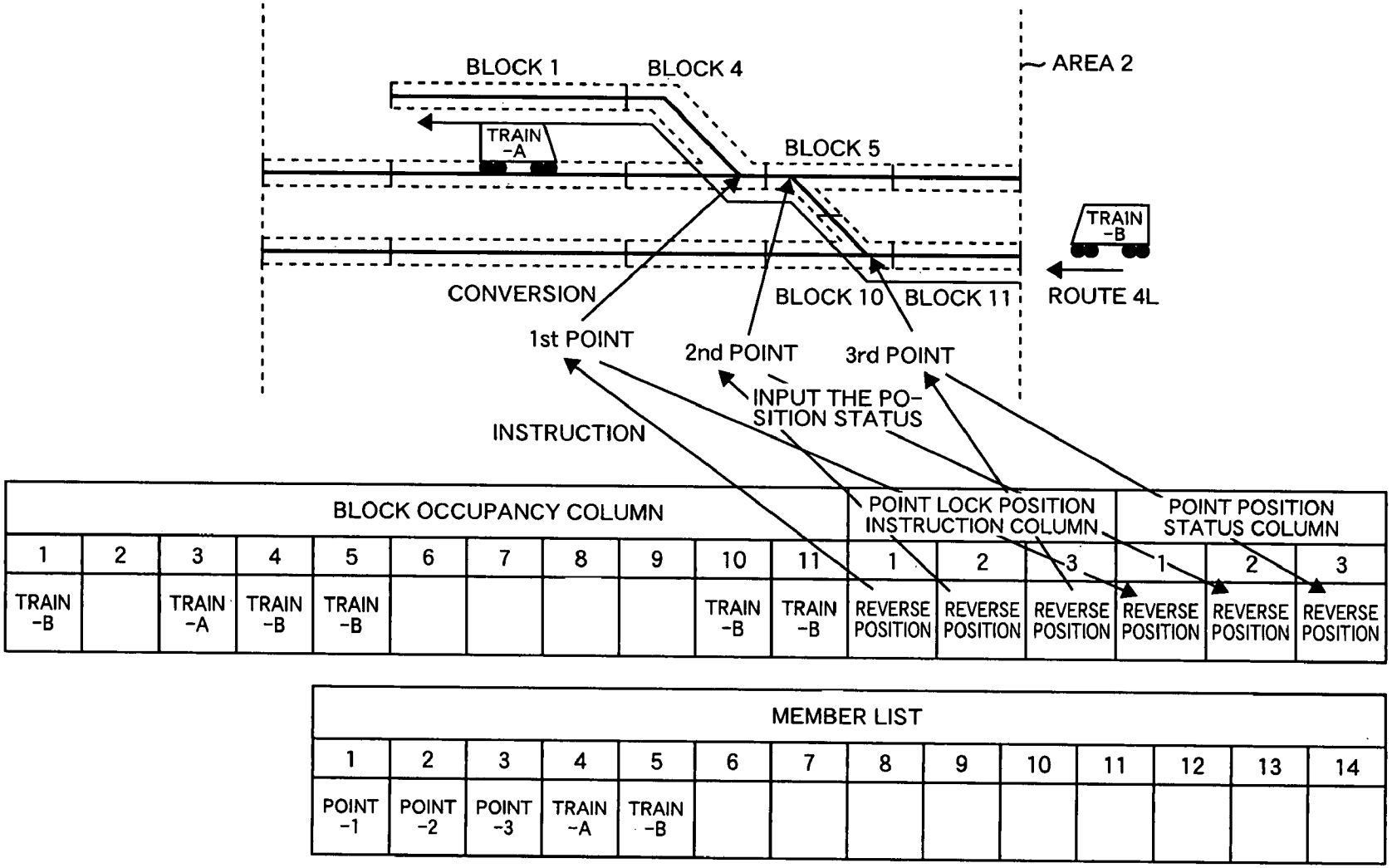
FIG. 10 is a diagram showing the mechanism of ensuring safety at the time of train operation according to the present invention.

State 5: Similarly, when the train B different from the train A is going to enter the area 2, it generates an addition request telegram requesting addition of the train B in the member list of the telegram, and sends it to the member holding the signaling telegram of the area 2. When the signaling telegram has been received by the train B, the train B identifies the member currently holding the right of occupying the block as a path to the requested route 4L. Since the occupancy column for that block does not include identification data of other trains, the train B inputs its own identification data. Since there is a point in the block whose right of occupancy has been obtained, consideration is given to the direction connected to the block consisting of the route 4L, for example, the point position instruction information in the point position instruction column, and "reverse position" is inputted in the point lock position instruction column of the signaling telegram. Then the signaling telegram is sent to the next member described in the member list (FIG. 9).

State 6: Upon receipt of the signaling telegram, the point device checks the signaling telegram for the point lock position instruction column of its own, and compares the direction described in the point position instruction column and the direction described in the point lock position status column. If they disagree, the point is switched over to the direction given in the point lock position instruction column. The position of the point is again checked, and the result is updated to the point position status column. Then the signaling telegram is sent to the next member described in the member list of the signaling telegram. This procedure allows the train to identify the position of the point on the route, using the signaling telegram having been sent. In the route 4L with a point located thereon, the right of occupying all the blocks on the route can be obtained. When it has been confirmed that the point on the route is placed in the specified direction, the train protection apparatus of the train sends the permission to travel on the route, to the driver cab of the train.

Figure 11:
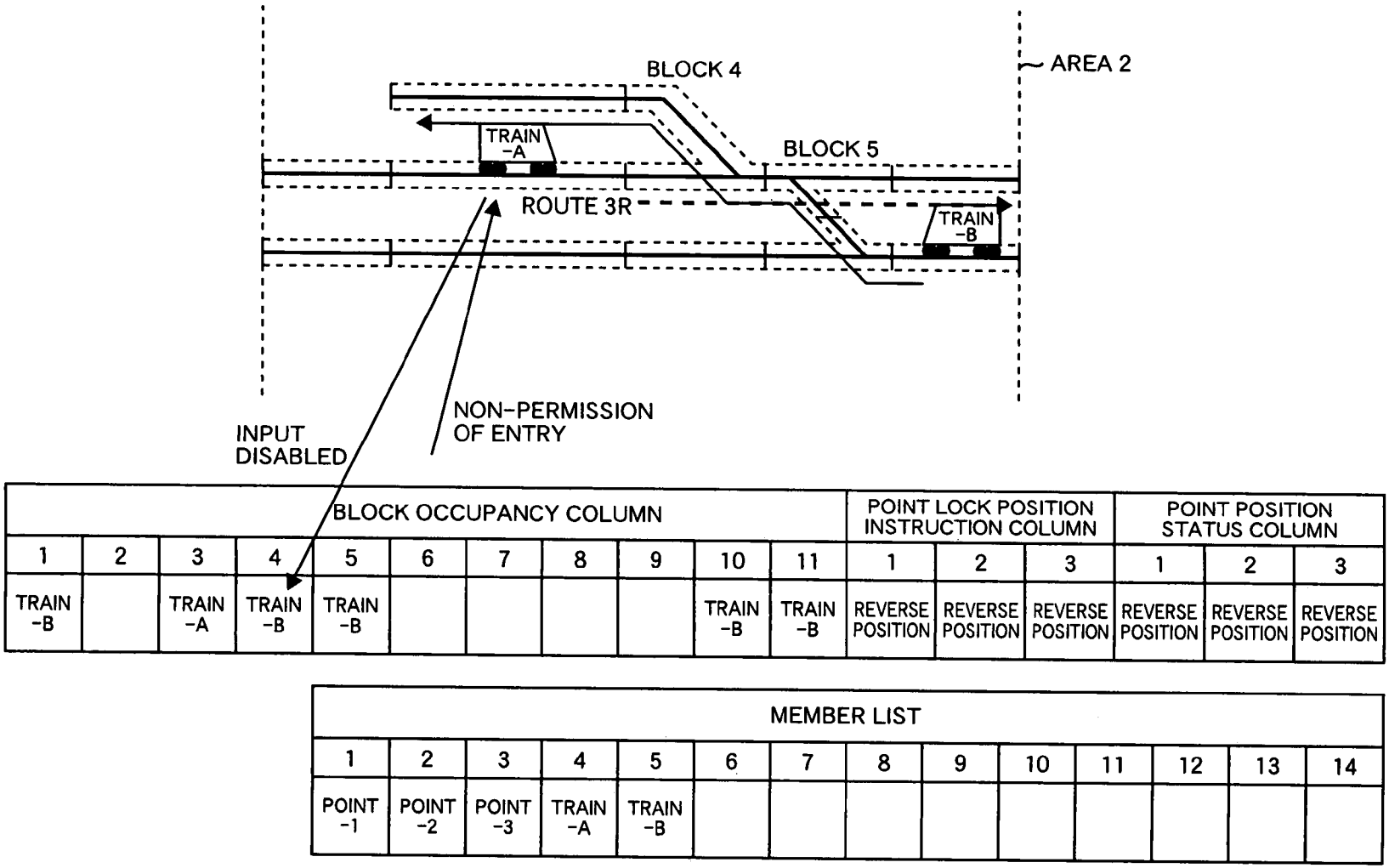
FIG. 11 is a diagram showing the mechanism of ensuring safety at the time of train operation according to the present invention.

State 7: Even if the train A has requested the right to use the competitive route 3R when the train B is running on the route 4L, the blocks 4 and 5 in the block occupancy column of the signaling telegram on the patrol have been secured by the train B. Therefore, the permission to enter the route 3R will never be granted to the train A (FIG. 11).

Figure 12:
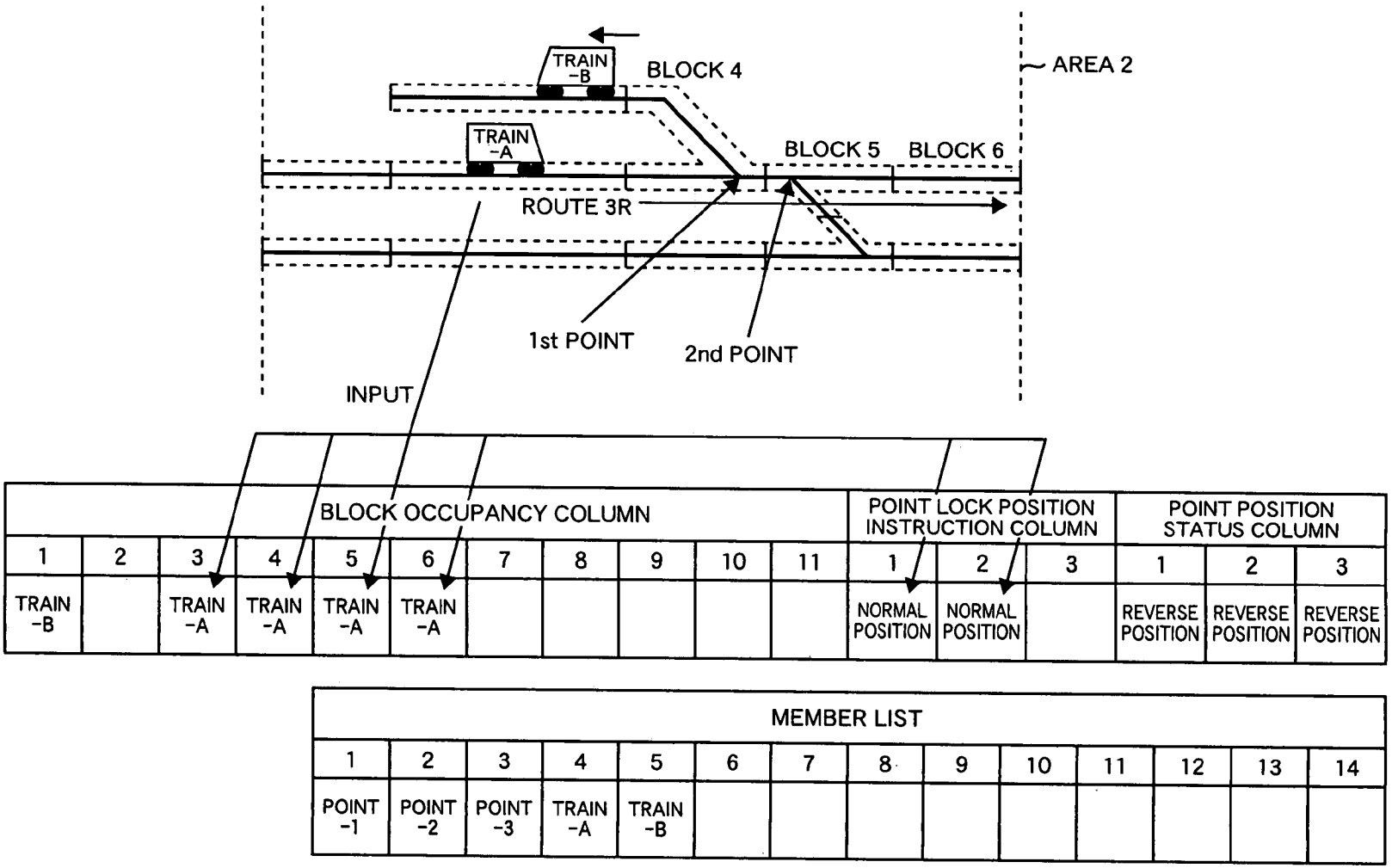
FIG. 12 is a diagram showing the mechanism of ensuring safety at the time of train operation according to the present invention.
Figure 13:
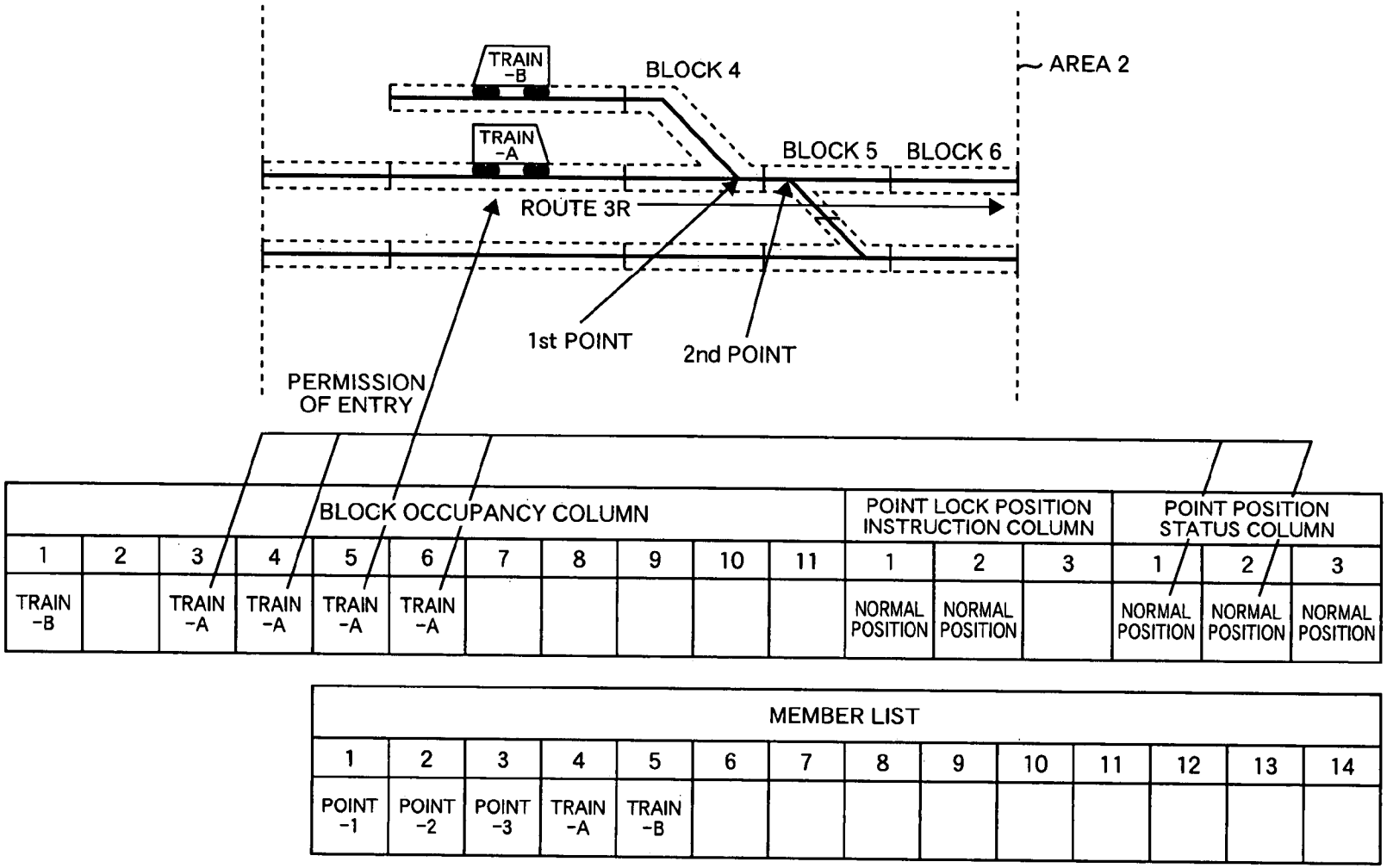
FIG. 13 is a diagram showing the mechanism of ensuring safety at the time of train operation according to the present invention.
Figure 14:
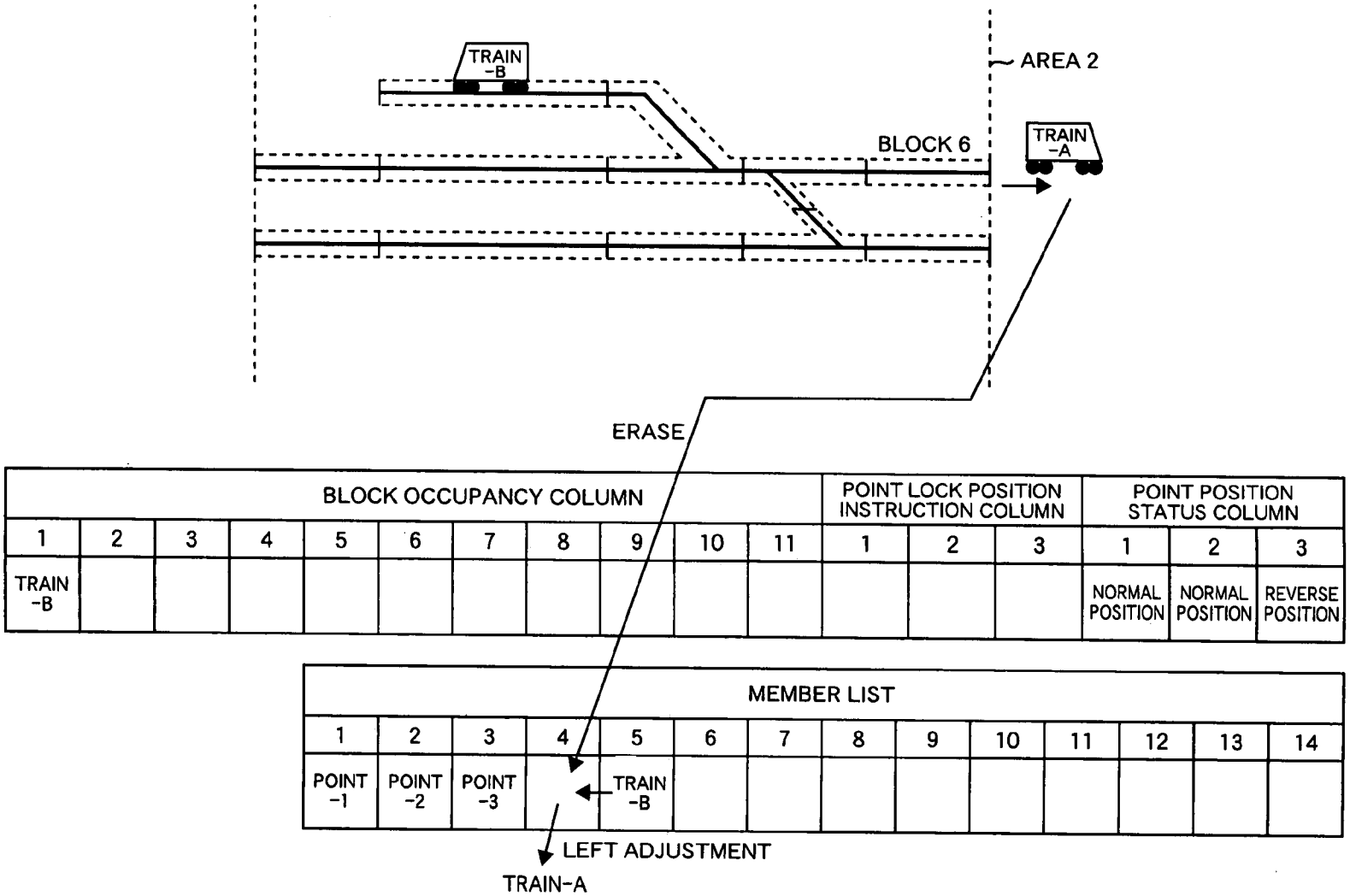
FIG. 14 is a diagram showing the mechanism of ensuring safety at the time of train operation according to the present invention.

State 8: When the trailing edge of the train B has left the block 4, the train B concedes the right of occupying the block 4. When the train A has received the signaling telegram after that, the train A is allowed to occupy all the blocks (blocks 4, 5 and 6) on the route 3R because identification data of other trains is not included for all of these blocks (FIG. 12).

State 9: When the information described in the point position status column of the signaling telegram for that point is "normal position" in the blocks 4 and 5 with points installed on the route 3R, namely, when the points of the blocks 4 and 5 with points installed on the route 3R have been positioned in such a way as to clear the route 3R, the train A is permitted to enter the route 3R.

State 10: After the trailing edge of the train A has left the block 6 to get out of the area 2, the train A erases the identification data of its own from the member list upon receipt of the next signaling telegram. The member list is left-adjusted and is sent to the next member. This procedure allows the train A to be excluded from the membership of the signaling telegram.

State 11: The signaling telegram of the area 2 patrols all the members, except for the train A having left the area 2.

As described above, the signaling system of the present invention uses only the telegram patrolling the trains and points as wayside equipment. This arrangement eliminates the need of an interlocking device or cables leading from the interlocking device to the wayside equipment such as a point, or simplifies the interlocking device or cables. This cuts down designing and manufacturing costs, and ensures safety in traffic operation.

Figure 15:
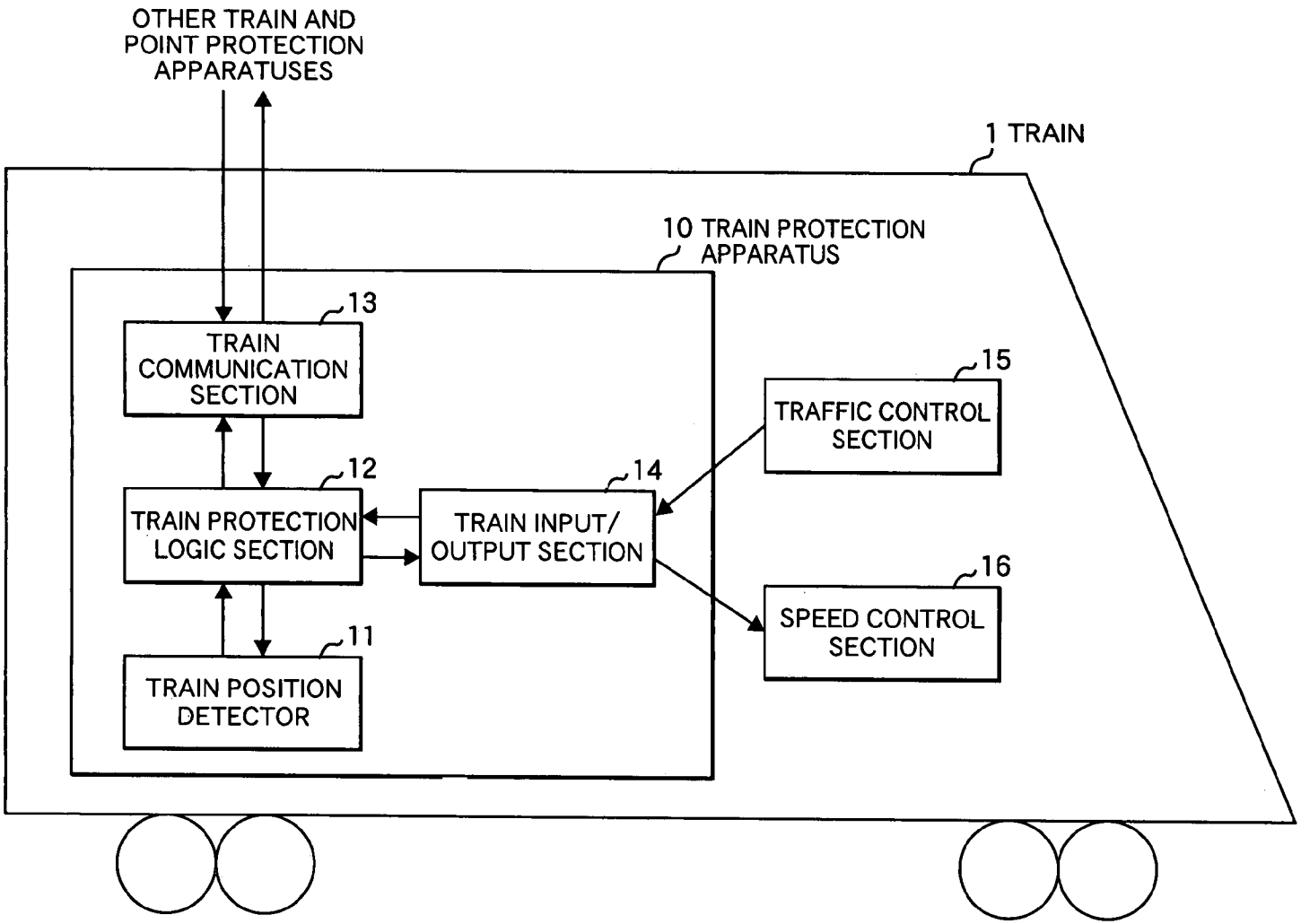
FIG. 15 is a diagram showing the embodiment of the train protection apparatus in the signaling system.

The train protection apparatus 10 has a train position detector 11, a train protection logic section 12, a train communication section 13 and a train input/output section 14, as shown in FIG. 15. Based on the signaling telegram and addition request telegram sent from the other train protection apparatuses and point protection apparatuses, as well as the route request information and route request cancel information sent from the traffic control section 15, the train protection apparatus 10 creates a signaling telegram, addition request telegram, route entry permission information and route entry permission cancel information. The train protection apparatus 10 sends the signaling telegram and addition request telegram to other train protection apparatuses and point protection apparatuses, and outputs the route entry permission information and route entry permission cancel information to the speed control section 16.

The traffic control section 15 generates the route request information for requesting permission to enter a route, or the route request cancel information for canceling the request, according to the train operation planning information stored in advance, and outputs them. For example, the traffic control section 15 contains an operation plan storage apparatus for storing the train operation planning information, a central operation control system for controlling the train operation, an apparatus for receiving train operation planning information from the train dispatcher, and an apparatus permitting input and output by the driver.

The speed control section 16 controls the traveling of the train to ensure that the permitted arrival point on the route will not be exceeded, on the basis of the route entry permission information inputted from the train protection apparatus 10 and the route entry permission cancel information. The speed control section 16 is exemplified as follows: One is the apparatus that creates a braking pattern wherein the train does not exceed the permitted arrival point of the route, and the brake is applied automatically if the train speed has exceeded the speed that braking pattern indicates. Another is the apparatus that automatically controls the train speed up to the permitted arrival point of the route. A further example is the apparatus that permits driver's input and output.

The route request information outputted from the traffic control section 15 refers to the information inputted into the train protection apparatus 10 when there is a request to enter the route the entry in which is not permitted. It includes the identification data of that route. The route request cancel information refers to the information inputted into the train protection apparatus 10 when canceling the route request information regarding the route where the entry permission having been requested becomes unnecessary due to the change in the train schedule. It includes the identification data of that route.

The route entry permission information inputted into the speed control section 16 from the train protection apparatus 10 refers to the information outputted by the train protection apparatus 10 to the speed control section 16, when safety has been ensured at the time of entry into the route by the train protection apparatus 10, namely, when the right of occupying all the blocks constituting the route has been secured by the present train, and the point on the route has been confirmed to have been cleared in the lock position specified by that train. It includes the identification data of this route. The route entry permission cancel information refers to the information that cancels the route entry permission information of the route outputted to the speed control section 16 by the train protection apparatus 10. It includes the identification data of this route.

The train position detector 11 of the train protection apparatus 10 detects the position information of the leading and trailing edges of the train, and outputs the detected position information to the train protection logic section 12. The position information includes the identification data of the block wherein an object is present, and the information on the distance from the end of this block.

Figure 16:
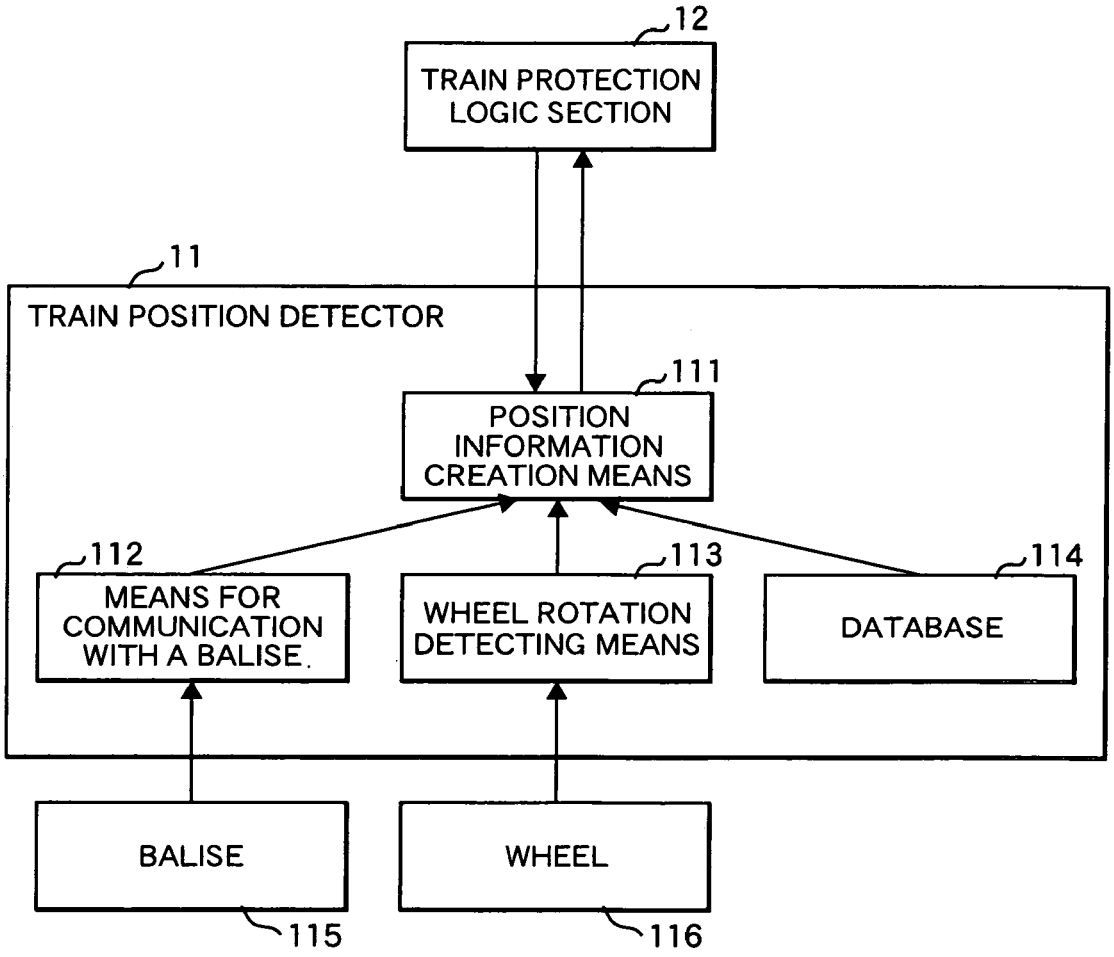
FIG. 16 is a diagram showing an embodiment of the train position detector in the train protection apparatus of FIG. 15.

The following describes the processing of the train position detector 11 of the present embodiment. As shown in FIG. 16, the train position detector 11 includes a position information creating means 111, a communication means 112 for communication with the balise, a wheel rotation detecting means 113 and a database 114.

The database 114 as an storage section inside the train position detector 11 for detecting the position of its own train and outputting that position information contains at least the position information having been detected through the communication means 112 from all the balises 115 located on the route where the train runs, the information on all the blocks where the train runs, and the diameter of the wheel detected by the wheel rotation detecting means 113 from the wheel 116. The block information includes the identification data of the pertaining area (pertaining section), the identification data on the adjacent block, and the boundary position with the adjacent block.

The communication means 112 for communication with the balises 115 receives the identification data from the balises 115 when the equipment provided with the communication means 112 has passed the balises 115, and outputs the received identification data on the balises to the position information creating means 111.

The wheel rotation detecting means 113 detects the speed of the wheel 116 and outputs the speed information as the result of detection to the position information creating means 111.

Using the balise identification data inputted from the communication means 112 for communication with the balises, the position information creating means 111 extracts the identification data of the block where the balises 115 are present and the distance from the block end, from the position information of the balise stored in the database 114. Based on the result of detection inputted from the wheel rotation detecting means 113 and the wheel diameter stored in the database 114, the position information creating means 111 calculates the traveling distance from the time when the train has passed the balise. Further, using the position of the equipment provided with the communication means 112 for communication with the balise having been measured in advance, and the distance of the leading and trailing edges of the train, the position information creating means 111 corrects the traveling distance and calculates the traveling distance of the leading and trailing ends of the train.

The block having been passed by the train after passing the balise is identified based on the block traveling information inputted from the train protection logic section 12. The block travel information is defined as the information storing the identification data in the order in which the train travels. This information is created by the train protection logic section 12.

The length of each block where the train has run is calculated based on the block information stored in the database 114. The traveling distance from the time point when the balise has been passed is compared with the length of each block traveled, and the block where the leading and trailing edges of the train are present and the distance from the end of that block are calculated. The position information creating means 111 sends the result of this calculation to the train protection logic section 12 as the position information of the leading and trailing edges of the train.

The position information of the leading and trailing edges of the train can be created by using other methods. For example, the GPS (Global Positioning System) can be used to identify the absolute position of the train, or a position detection tag can be used to detect the block where the train is present. When the GPS is used, a further cost reduction will be possible. If the position detection tag is utilized, more accurate position detection will be possible.

Figure 17:
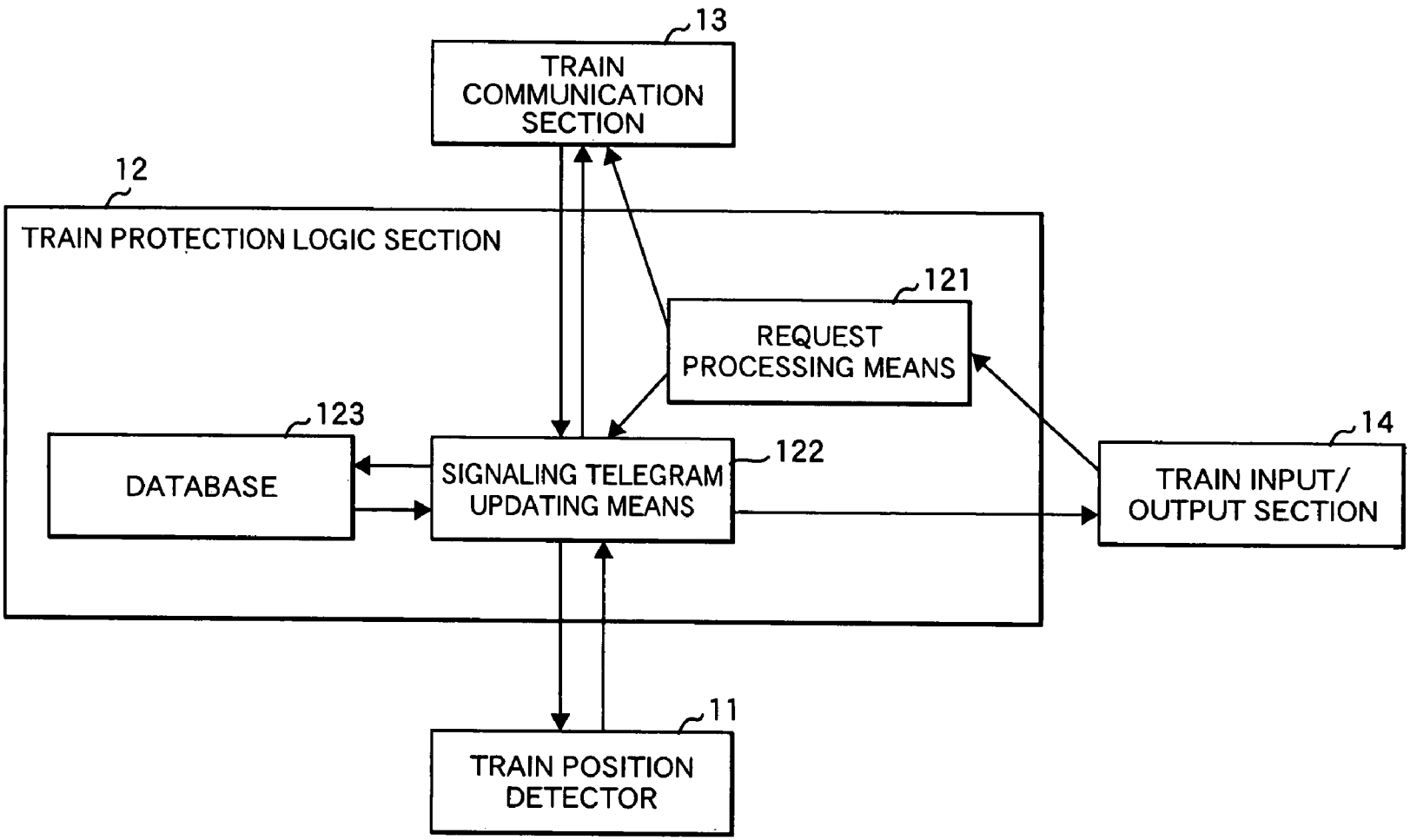
FIG. 17 is a diagram showing an embodiment of the train protection logic section in the train protection apparatus of FIG. 15.

The following describes the train protection logic section 12 with reference to FIG. 17.

Based on the route request information and route request cancel information inputted from the train input/output section 14, the addition request telegram and signaling telegram inputted from the train communication section 13, and the leading and trailing edges of the train inputted from the train position detector 11, the train protection logic section 12 creates the route entry permission information, route entry permission cancel information, addition request telegram and block traveling information. The other function of the train protection logic section 12 is to update the signaling telegram, and outputs the created route entry permission information and route entry permission cancel information to the train input/output section 14, the created addition request telegram and signaling telegram to the train communication section 13, and the created block traveling information to the train position detector 11.

The following describes the processing of the train protection logic section 12 of the present embodiment:

The train protection logic section 12 includes a request processing means 121, signaling telegram updating means 122 and database 123, as shown in FIG. 17.

The database 123 as a storage section of the train protection logic section 12 contains at least route information, block information and information on train stop distance with respect to initial braking speed. The route information includes the identification data of the blocks on the route arranged in the order in which the train travels, the identification data of the point on each block, and the lock position of the point for passing the train. In this case, the block information may contain a common database that can be accessed by the train position detector 11 and train protection logic section 12. This will reduce the overall storage capacity of the database.

Figure 18:
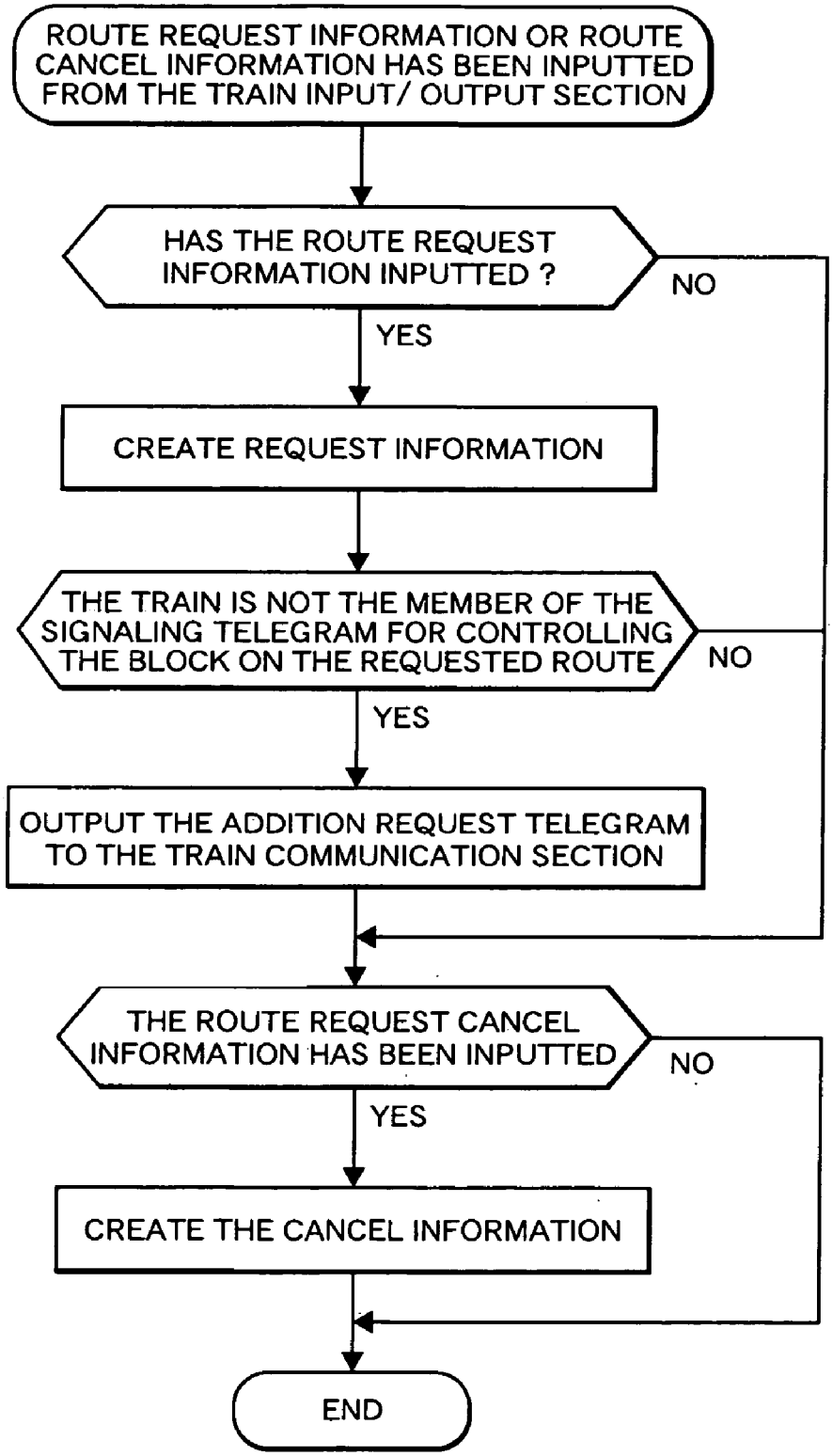
FIG. 18 is a diagram showing an example of the flow of processing in the request processing means in the train protection logic section of FIG. 17.

The request processing means 121 starts processing when the route request information or route request cancel information has been inputted from the train input/output section 14. FIG. 18 is a flow chart representing the processing made by the request processing means 121.

In the first place, using the identification data of the requested route contained in the route request information, the identification data of the blocks arranged in the order in which the train travels, the identification data of the point of each block, and the direction in which the said route is connected are extracted from the route information stored in the database 123. Then the request information is generated and stored in the storage section.

Using the identification data of the blocks contained in the generated request information, the area to which the block belongs is extracted from the block information in the database 123. If the train is not the member of the signaling telegram controlling that area, the addition request telegram including the identification data of that area and the identification data of the train is outputted to the train communication section 13.

Using the identification data of the cancelled route contained in the route request cancel information, the identification data of the blocks arranged in the order in which the train travel and the identification data of the point of each block are extracted from the route information stored in the database 123. Then the cancel information is generated and stored in the storage section.

The following describes one embodiment of the signaling telegram updating means 122. When the signaling telegram has been inputted from the train communication section 13, the signaling telegram updating means 122 processes the following steps 1 through 5 sequentially.

Figure 19:
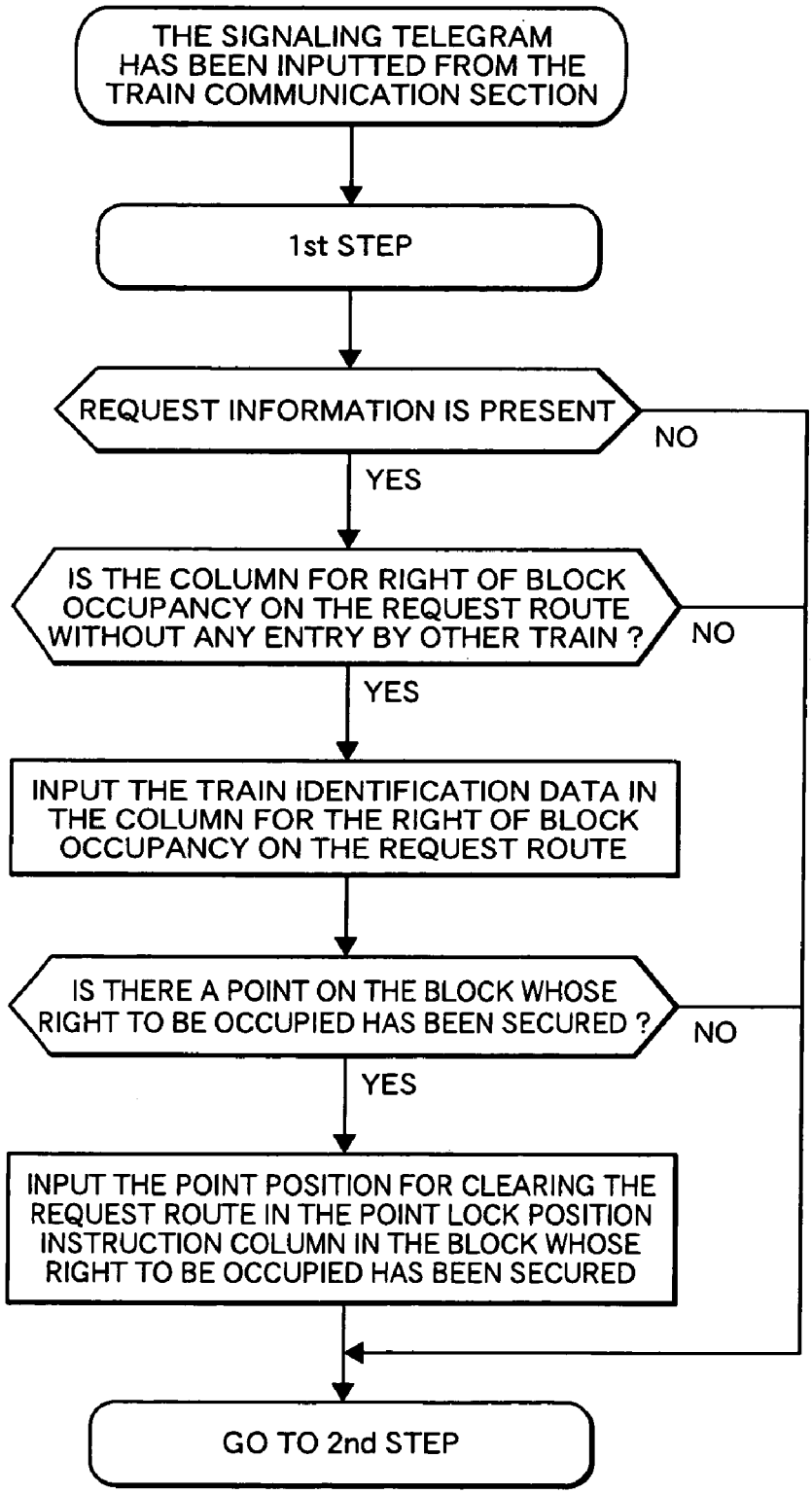
FIG. 19 is a flow chart showing the processing in the first step of a signaling telegram updating means in the train protection logic of FIG. 15.

FIG. 19 shows the processing flow in the first step. In the first place, when the request processing means 121 stores the request information, the signaling telegram updating means 122 checks the block occupancy column for the block on the requested route in the signaling telegram, based on the identification data of the block contained in the request information. If it does not contain any description by other trains, the identification data of the present train is inputted in the block occupancy column in order to get the right of block occupancy. Further, if there is a point in the block which the train has acquired the right of occupying, the lock position for clearing this route is described in the point lock position instruction column, based on the identification data of the point in the block contained in the request information and the lock position for clearing this route. The system proceeds to the step 2.

Figure 20:
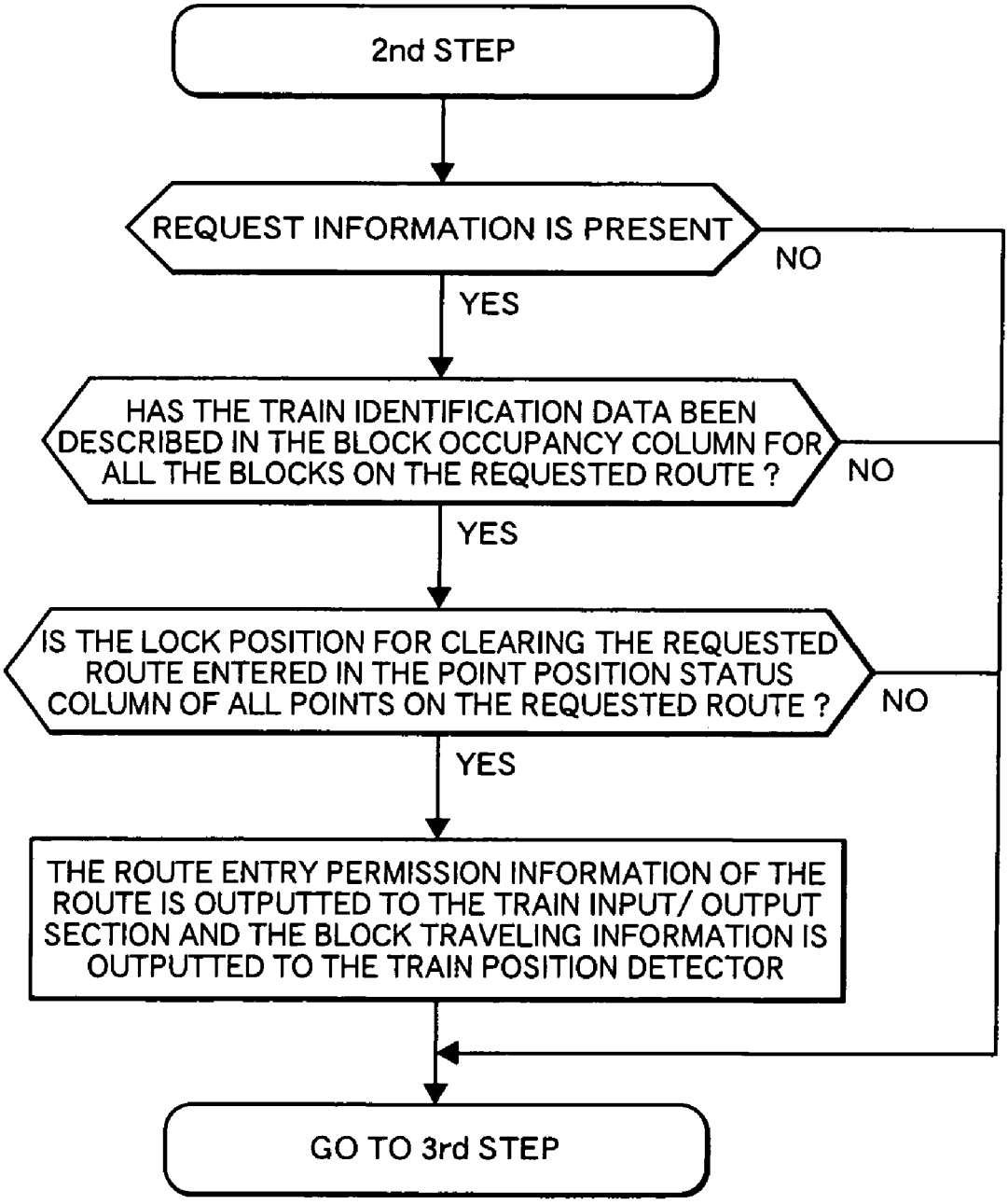
FIG. 20 is a flow chart showing the processing in the second step of a signaling telegram updating means in the train protection logic of FIG. 15.

FIG. 20 is a flow chart representing the processing in the step 2. In the first place, when the request processing means 121 stores the request information, the signaling telegram updating means 122 checks the block occupancy column for all the blocks on the requested route in the signaling telegram, based on the identification data of the block contained in the request information, the identification data of the point in each block and the lock position of the route. If the identification data of that train is described in the block occupancy column for all the blocks on the requested route in the signaling telegram, and the position for clearing the requested route is described in the point position status column for the points in all blocks, then a decision step is taken to determine that the route has been cleared. The signaling telegram updating means 122 outputs the identification data of the requested route to the train input/output section 14 as the route entry permission information. Further, the identification data of the blocks arranged in the order in which the train travels, in the request information, is outputted to the train position detector 11 as the block traveling information by the signaling telegram updating means 122. Then the system proceeds to the step 3.

Figure 21:
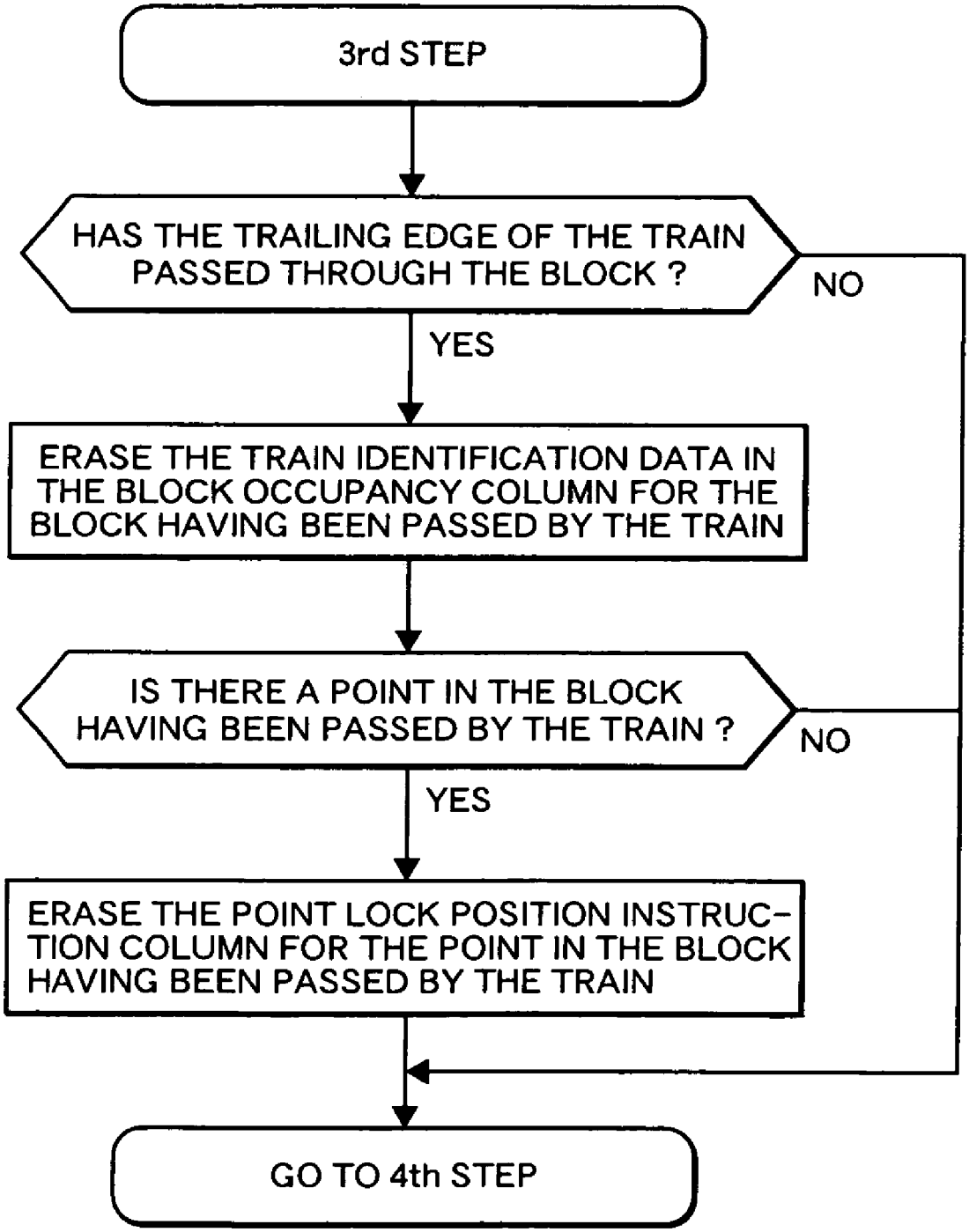
FIG. 21 is a flow chart showing the processing in the third step of a signaling telegram updating means in the train protection logic of FIG. 15.

FIG. 21 is a flow chart representing the processing in the step 3. A decision is made whether or not the trailing edge of the train has passed the block contained in the block traveling information, based on the position information of the leading and trailing edges of the train inputted from the train position detector 11, and the block traveling information created in the step 2 by the signaling telegram updating means 122. A decision step is taken to determine that the trailing edge has passed the block before the block where the trailing edge of the train is located, in terms of the order of traveling. The signaling telegram updating means 122 erases the identification data of its own train described in the block occupancy column for that block in the signaling telegram. It also erases the position instruction described in the point lock position instruction column. Then the system proceeds to the step 4.

Figure 22:
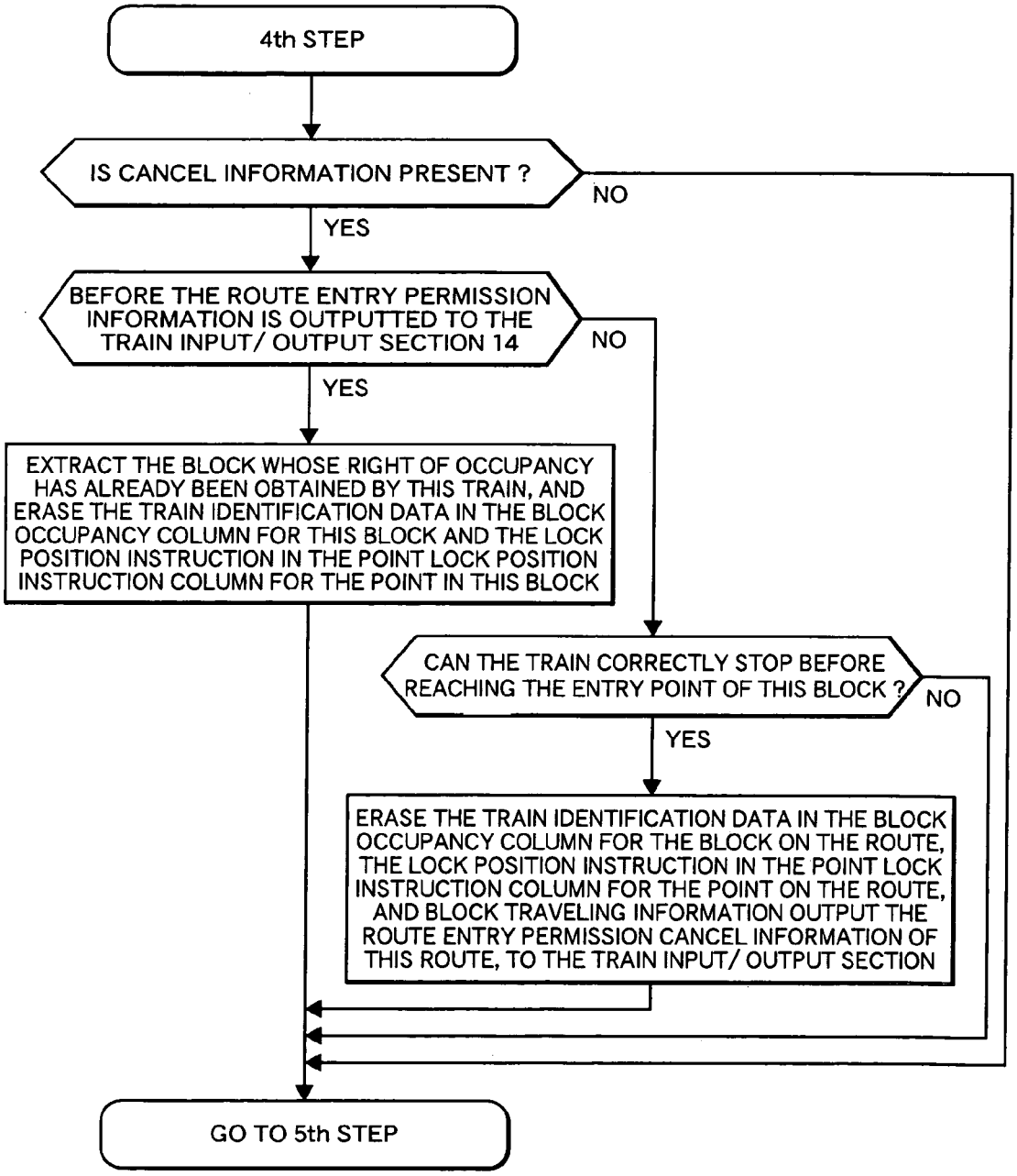
FIG. 22 is a flow chart showing the processing in the fourth step of a signaling telegram updating means in the train protection logic of FIG. 15.

FIG. 22 is a flow chart representing the processing in the step 4. When the request processing means 121 stores the cancel information and the route entry permission information has not yet been outputted to the train input/output section 14, then the signaling telegram updating means 122 extracts the block whose right of block occupancy has already been obtained by its own train, from the blocks on the route, based on the identification data of the block contained in the cancel information and the identification data of the point in each block. Then it erases the identification data of its own train described in the block occupancy column for the block of the signaling telegram. It also erases the lock position instruction described in the point lock position instruction column for the point in the block.

When the route entry permission information has been outputted to the train input/output section 14, the signaling telegram updating means 122 determines whether or not the train can be safely stopped before the route entry point. If the train can be stopped safety, the signaling telegram updating means 122 erases the identification data of its own train described in the block occupancy column for the block on the route of the signaling telegram and the lock position instruction described in the point lock position instruction column for the point on the route, based on the identification data of the block contained in the cancel information and the identification data of each point in the block. Then the system proceeds to the step 5.

Figure 23:
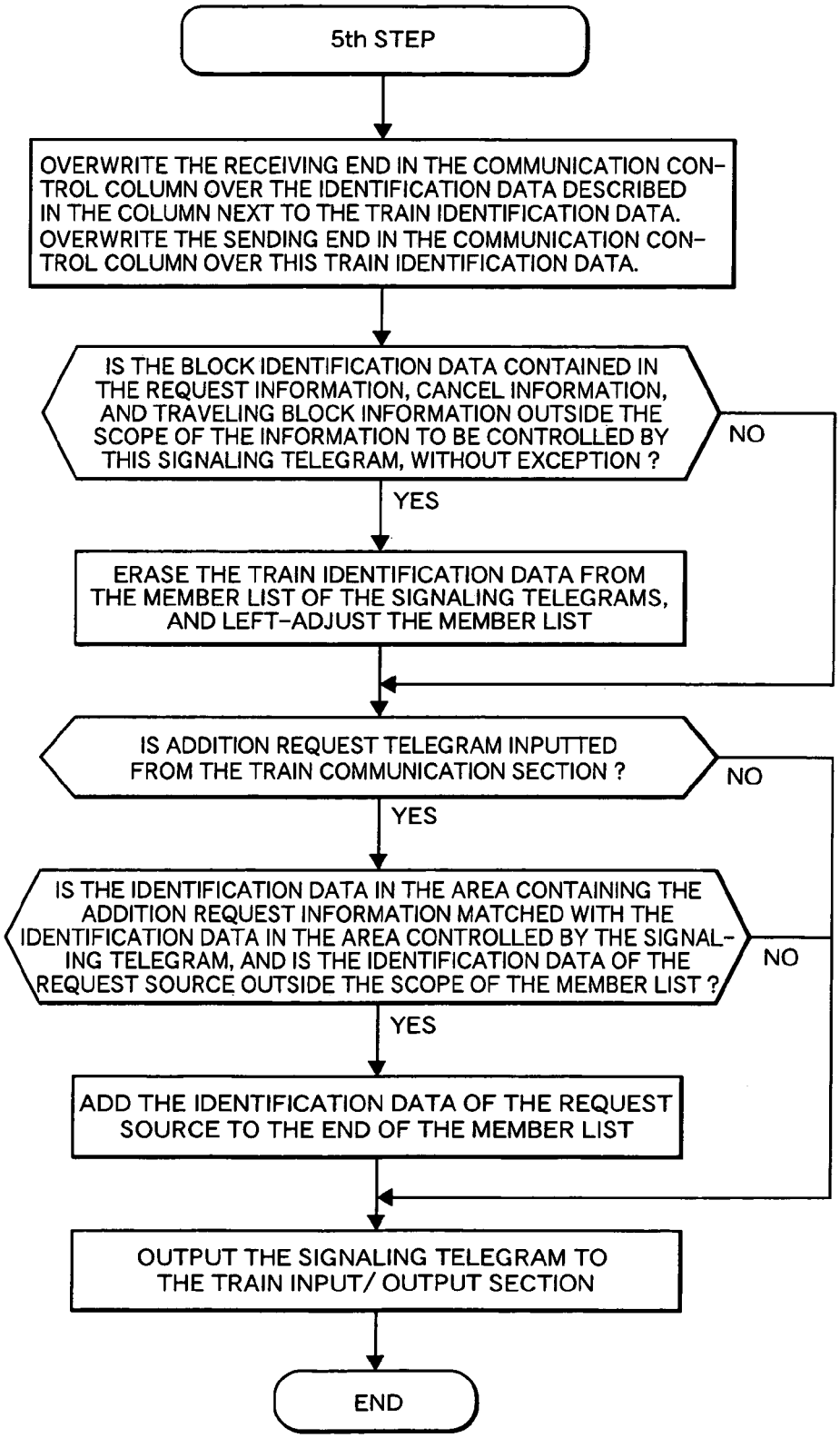
FIG. 23 is a flow chart showing the processing in the fifth step of a signaling telegram updating means in the train protection logic of FIG. 15.

The following procedure can also be used to determine whether or not the train can be stopped safety before it reaches the entry point on the route: For example, the position information of the leading edge is captured several times from the train position detector 11 and the current speed is calculated from the changes in position. Then the distance from the current position to the entry point on the route is compared with the stop position at the current speed, based on the information on the stop distance on the route with respect to the initial braking speed stored in the database 123 in advance, the position information on the leading edge of the train, block traveling information and block information. In this case, it is also possible to make such arrangements that the speed control section 16 makes the aforementioned decision and the train input/output section 14 is allowed to input the route cancel information only when the train can be stopped safety before reaching the entry point on the route. This arrangement eliminates the need of storing the information on the stop distance of the train with respect to the initial braking FIG. 23 shows the flow chart representing the processing in step 5. Based on the member list of the signaling telegram, the signaling telegram updating means 122 overwrites the identification data described in the column next to the identification data of the train, over the receiving end of the communication control column in the signaling telegram and overwrites the identification data of its own train on the sending end. If that train is located at the end of the member list, the next column corresponds to item No. 1 in the member list. If not any one of the request information stored in the request processing means 121, the cancel information, and the identification data of the block contained in the block traveling information created by the signaling telegram updating means 122 is placed under the control of the signaling telegram, the train is determined to have left the area. The signaling telegram updating means 122 erases the identification data of that train from the member list of the signaling telegram. Then the member list is left-adjusted. Further, when the addition request telegram has been inputted from the train communication section 13, the identification data of the area containing the addition request telegram and the identification data of the area under the control of that signaling telegram are checked. If there is agreement between the identification data of the area contained in the addition request telegram and the identification data of the area under the control of the signaling telegram, and the identification data of the source of the addition request telegram is not found in the member list, then the identification data of the request source is added at the end of the member list. Lastly, the signaling telegram updating means 122 the signaling telegram to the train communication section 13. If the member described in the member list consists of only its own train, updating of the signaling telegram continues in the signaling telegram updating means 122, until an addition request telegram is inputted by other train protection section.

Figure 24:
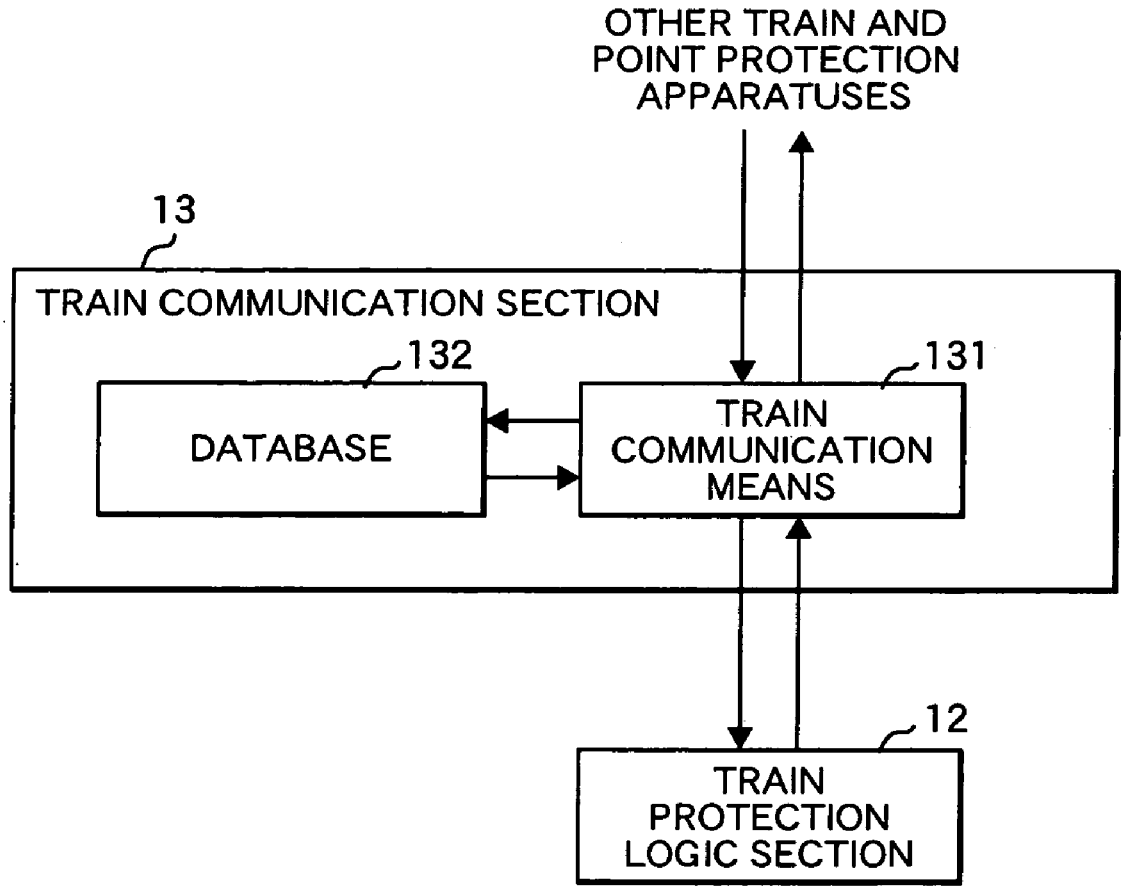
FIG. 24 is a diagram showing an embodiment of the train communication section in the train protection logic of FIG. 15.

Referring to FIG. 24, the following describes the train communication section 13.

The train communication section 13 has a train communication means 131 and a database 132. The train communication means 131 receives the signaling telegram and addition request telegram sent from other train protection apparatus and point protection apparatus. It also has a function of sending the signaling telegram and addition request telegram inputted from the train protection logic section 12, to other train protection apparatus and point protection apparatus.

The database 132 inside the train communication section 13 stores the constituent information for each area. The constituent information includes the identification data of the train which may run in the area, and the identification data of the point located in the area.

The following describes the processing of the train communication means 131.

The present embodiment uses a radio communication means for communication among the train and point protection apparatuses. When a signaling telegram has been sent to the train from the other train protection apparatus or point protection apparatus, the train communication means 131 receives it and outputs it to the train protection logic section 12. When a signaling telegram has been inputted from the train protection logic section 12, the train communication means 131 sends the signaling telegram by radio to the other party described in the receiving end of the communication control column of the signaling telegram. Further, if an addition request telegram has been sent by radio from other train protection apparatus, the train communication means 131 sends this addition request telegram to the train protection logic section 12. When an addition request telegram has been inputted from the train protection logic section 12, the train communication means 131 sends the addition request telegram by radio to the train protection apparatus for the train that may run in that area and the point protection apparatus for the point devices located in that area, based on the constituent information stored in the database 132.

Satellite communication based on an artificial satellite or telephone line communication based on a cellular mobile telephone, other than the aforementioned form of radio communication, can be used for communication with other train protection apparatus and point protection apparatus. In this case, longer distance communication is possible than that based on radio communication method. In this case, the area to be controlled by one signaling telegram can be set to a wider level.

When a signaling telegram is exchanged, it is necessary to use the procedure capable of ensuring that the telegram has been safely sent to the other party, thereby avoiding possible interception or interference of radio waves and tampering, copying and loss of data. This procedure includes encryption and decryption of the message, addition of serial numbers and chronological information, checking of communication time, and preliminary check and follow-up check of the sending and receiving ends.

As shown in FIG. 15, the train input/output section 14 sends the route request information or the route request cancel information inputted from the traffic control section 15, to the train protection logic section 12. It also has a function of outputting the route entry permission information or route entry permission cancel information inputted from the train protection logic section 12, to the speed control section 16.

The following describes the processing of the train input/output section 14.

When the route request information has been inputted from the traffic control section 15, the train input/output section 14 outputs the identification data of that route to the train protection logic section 12 as the route request information. When the route request cancel information has been inputted from the speed control section 16, the train input/output section 14 outputs the identification data of the route to the train protection logic section 12 as the route request cancel information. When the route entry permission information has been inputted from the train protection logic section 12, the train input/output section 14 outputs the identification data of the route to the speed control section 16 as the route entry permission information. When the route entry permission cancel information has been inputted from the train protection logic section 12, the train input/output section 14 outputs the identification data of the route to the speed control section 16 as the route entry permission cancel information.

When the driver inputs information into the train input/output section 14, it is necessary to use a keyboard, mouse, or switch.

When storage apparatus for storing operation planning information, central traffic control system or train dispatcher input information into the train input/output section 14, it is necessary to use a device capable of communication with these apparatuses. When information is to be outputted to the driver from the train input/output section 14, it is necessary to use a display or a lamp.

When information is to be outputted to speed control apparatuses, it is necessary to use a device capable of communication with these apparatuses.

Figure 25:
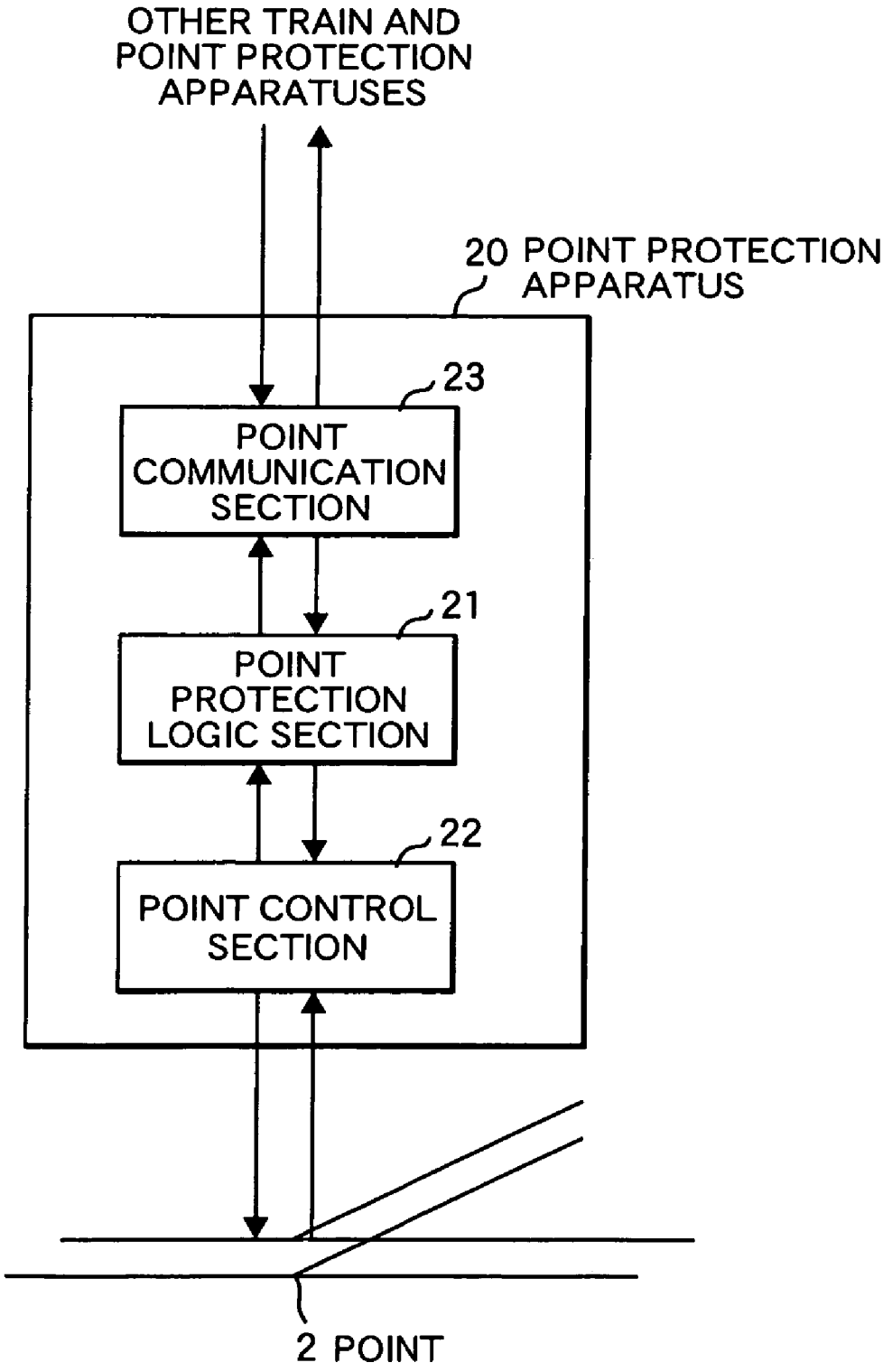
FIG. 25 is a diagram showing an embodiment of the point protection apparatus of a signaling system in the present invention.

The following describes an embodiment of the point protection apparatus 20 with reference to FIG. 25.

The point protection apparatus 20 has a point protection logic section 21, a point communication section 23 and a point control section 22. The point protection apparatus 20 creates the point lock position instruction information described in the point lock position instruction column of the signaling telegram, based on the signaling telegram or addition request telegram sent from other train protection apparatus and point protection apparatus, and the result of monitoring the position of the point 2 controlled by that apparatus. The point protection apparatus 20 sends the created signaling telegram to other train protection apparatus and point lock position information, and controls the point 2 to be set to the lock position of the created point lock position instruction information.

The point communication section 23 receives the signaling telegram or addition request telegram from the other train protection apparatus and point protection apparatus and outputs them to the point protection logic section 21. The point communication section 23 also has a function of sending the signaling telegram inputted from the point protection logic section 21, to the other train protection apparatus and point protection apparatus.

The following describes the processing of the point communication section 23. The present embodiment uses a radio communication means for communication among the protection apparatuses. When a signaling telegram has been sent to the train from the other train protection apparatus or point protection apparatus, the point communication section 23 receives it and outputs it to the point protection logic section 21. Further, when a signaling telegram has been inputted from the point protection logic section 21, the point communication section 23 sends the signaling telegram by radio to the other party described in the receiving end of the communication control column of the signaling telegram. Further, if an addition request telegram has been sent by radio from other train protection apparatus, the point communication section 23 receives this addition request telegram and outputs it to the point protection logic section 21.

Satellite communication based on an artificial satellite or telephone line communication based on a cellular mobile telephone, other than the aforementioned form of radio communication, can be used for communication with other train protection apparatus and point protection apparatus. In this case, longer distance communication is possible than that based on radio communication method. In this case, the area to be controlled by one signaling telegram can be set to a wider level.

When a signaling telegram is exchanged, it is necessary to use the procedure capable of ensuring that the telegram has been safely sent to the other party, thereby avoiding possible interception or interference of radio waves and tampering, copying and loss of data. This procedure includes encryption and decryption of the message, addition of serial numbers and chronological information, checking of communication time, and preliminary check and follow-up check of the sending and receiving ends.

The following describes the point control section 22. The point control section 22 controls the lock position of the point based on the point lock position instruction column. The point control section 22 also has a function of monitoring the point, creates the point position information and outputs it to the point protection logic section 21.

The following describes the processing of the point control section 22 in the present embodiment.

When the point lock position instruction information has been inputted from the point protection logic section 21, the point control section 22 controls the point 2 to be set to the lock position specified by the point lock position instruction information. The point control section 22 also monitors the position of the point 2 and checks if the point 2 is set to the normal, reverse or free position. If the point 2 is set to the normal position, the point control section 22 sends the point position status information provided with the normal point position information to the point protection logic section 21. If the point 2 is set to the reverse position, it sends the point position status information provided with the reverse point position information. If the point 2 is set to the free position, it sends the point position status information provided with the free point position information.

Based on the addition request telegram and signaling telegram from the point communication section 23, the point protection logic section 21 creates the point lock position instruction information in the point lock position instruction column, and outputs it to the point control section 22.

Based on the position specified in the point position status information from the point control section 22, the point protection logic section 21 updates the point position status column of the signaling telegram, and outputs it to the point communication section 23. The point position status information refers to the three positions—normal, reverse and free—, as described above. The point lock position instruction information is the information that provides the point with the instruction on lock position. There are two lock position instructions given to the point; normal and reverse position instructions.

The following describes the processing of the point protection logic section 21 in the present embodiment.

Figure 26:
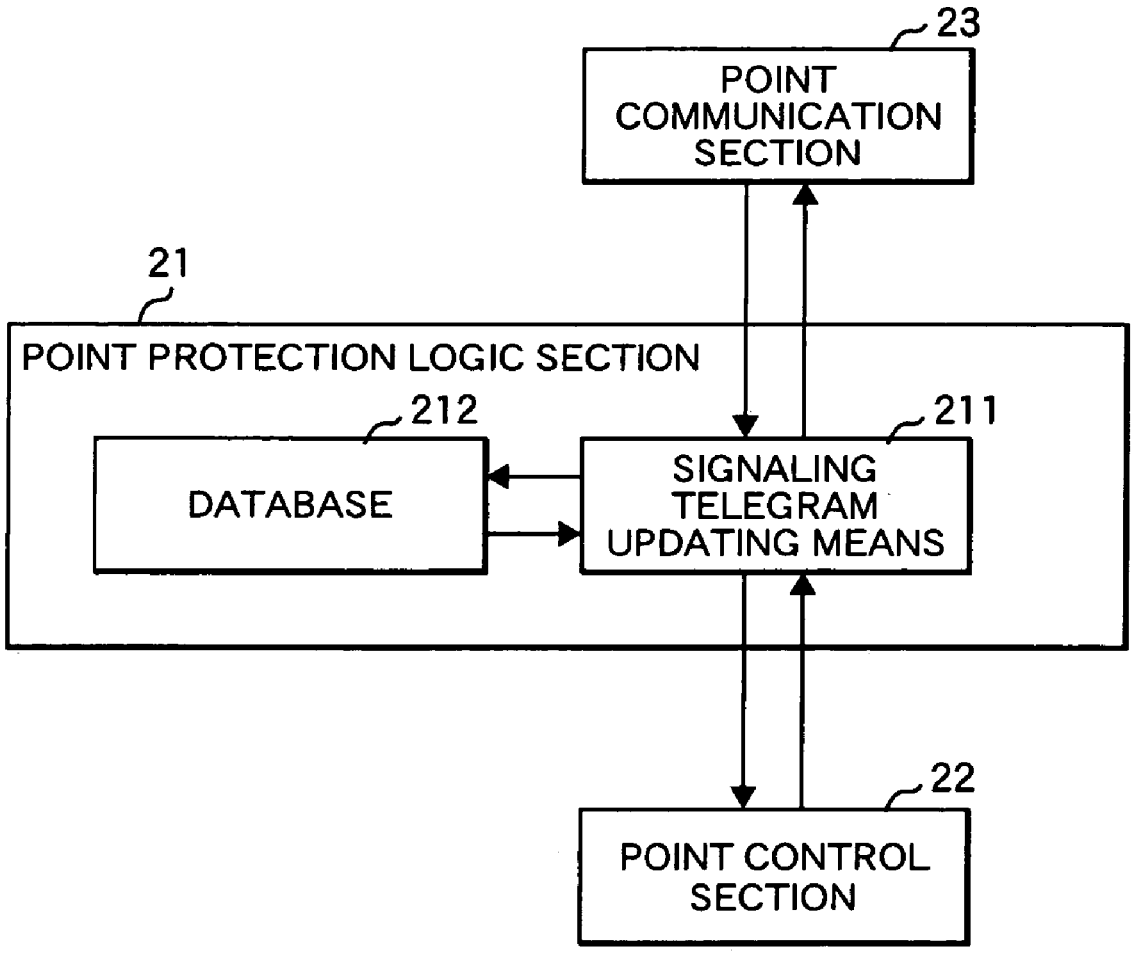
FIG. 26 is a diagram representing an embodiment of the point protection logic section of the point protection apparatus of FIG. 25.

As shown in FIG. 26, the point protection logic section 21 has a signaling telegram updating means 211 and a database 212. The database 212 inside the point protection logic section 21 stores the identification data of the point to be controlled.

The signaling telegram updating means 211 will be described in the order of steps 1 to 3, with reference to an embodiment of the processing to be performed when a signaling telegram has been inputted from the point communication section 23.

Figure 27:
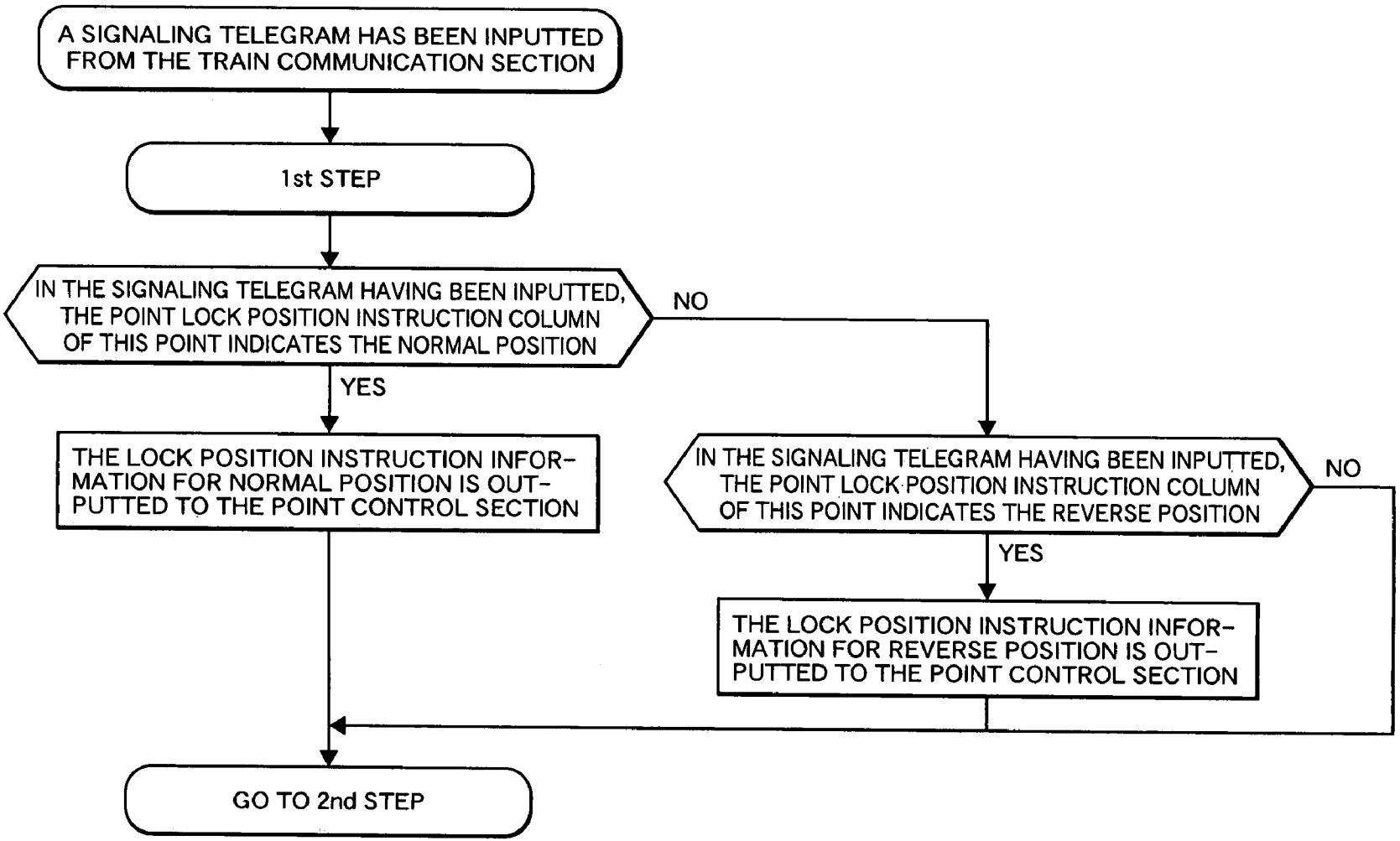
FIG. 27 is a flow chart representing the processing in the first step of the signaling telegram updating means of the point protection logic section of FIG. 26.

FIG. 27 is a flow chart representing the processing to be performed in step 1. In the first place, the database 212 stores whether the point position status information inputted form the point control section 22 refers to the normal, reverse or free position. Then, based on the point identification data stored in the database 212, the signaling telegram updating means 211 allows the database 212 to store the lock position indicated in the point lock position instruction column of the point in the signaling telegram. When the point is not in the normal position and the normal position is specified in the point lock position instruction column of the point in the signaling telegram, the signaling telegram updating means 211 allows the normal point lock position instruction information to be outputted to the point control section 22. When this point is not in the reverse position and the reverse position is specified in the point lock position instruction column of this point in the signaling telegram, the signaling telegram updating means 211 allows the reverse point lock position instruction information to be outputted to the point control section 22. Then the system proceeds to the step 2.

Figure 28:
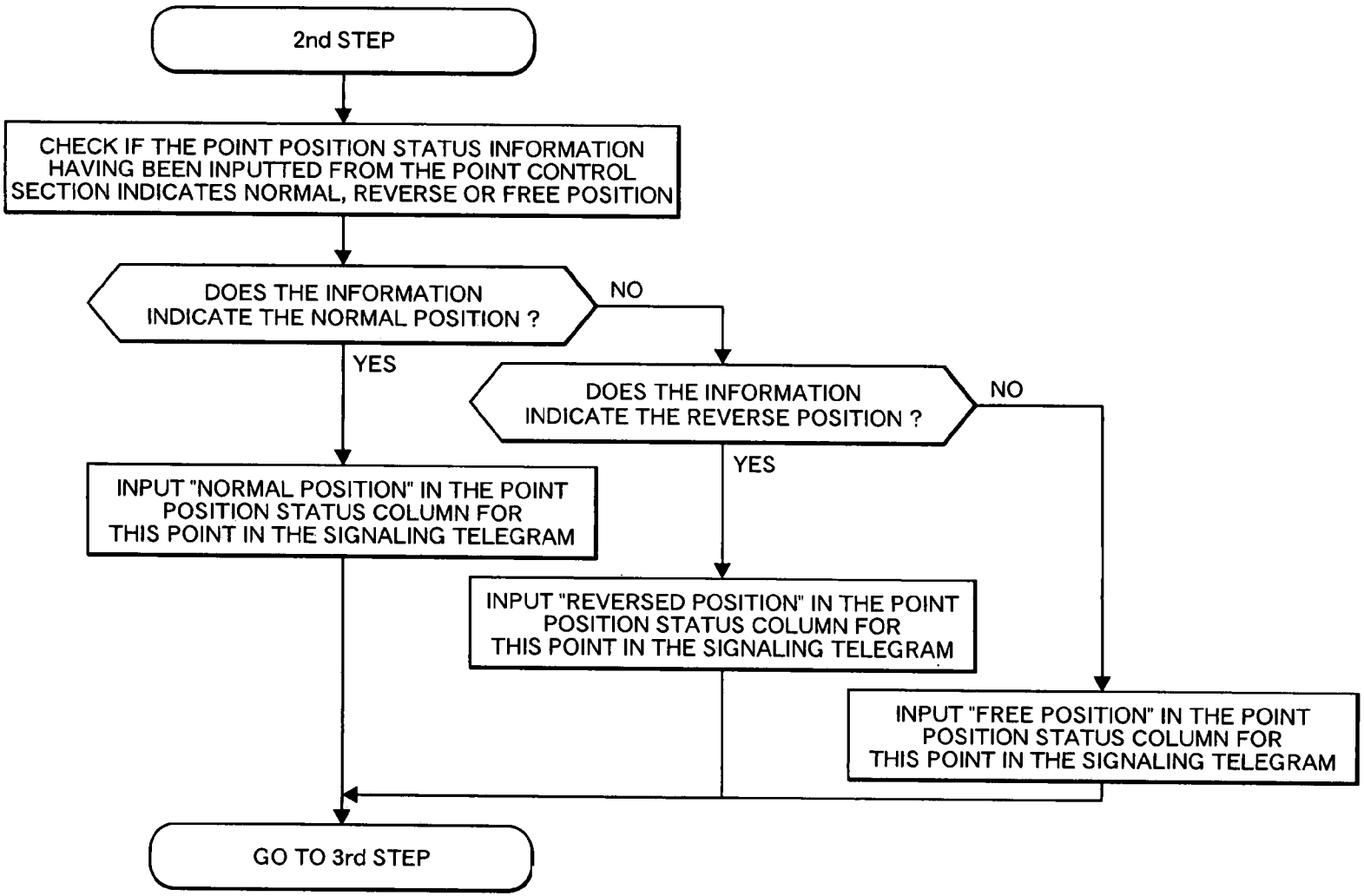
FIG. 28 is a flow chart representing the processing in the second step of the signaling telegram updating means of the point protection logic section of FIG. 26.

FIG. 28 is a flow chart representing the processing in step 2. In the first place, the signaling telegram updating means 211 allows the database 212 to store whether the point position information inputted from the point control section 22 refers to the normal, reverse or free position. Based on the result of this checking and the identification data of the point stored in the database 212, the signaling telegram updating means 211 inputs the position stored in the point position status column of this point in the signaling telegram. Then the system proceeds to the step 3.

Figure 29:
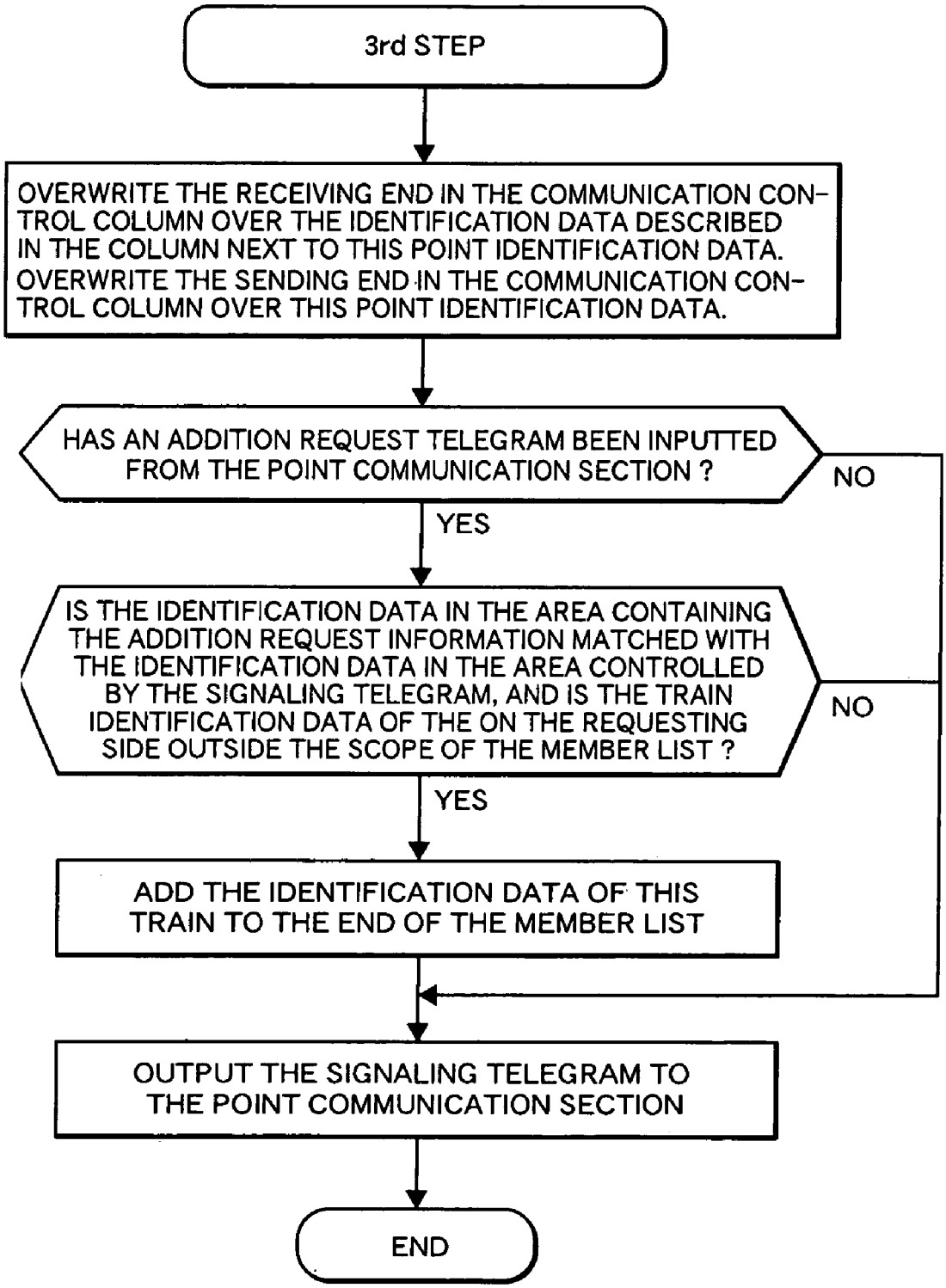
FIG. 29 is a flow chart representing the processing in the third step of the signaling telegram updating means of the point protection logic section of FIG. 26.

FIG. 29 is a flow chart representing the processing in step 3. In the first place, based on the member list of the signaling telegram, the signaling telegram updating means 211 overwrites the identification data described in the next column of the identification data of this point over the receiving end in the communication control column of the signaling telegram, and overwrites the identification data of this point over the sending end. If this point is located at the end of the member list, the next column corresponds to the member list 1. Then when an addition request telegram has been inputted from the point communication section 23, the signaling telegram updating means 211 checks the identification data of the area included in the addition request telegram and that of the area under the control of this signaling telegram. If there is agreement between the identification data of the area included in the addition request telegram and that of the area under the control of this signaling telegram, and the identification data of the train of the source of request included is not found in the member list in the signaling telegram, the identification data of this train is added to the end of the member list. Lastly, the signaling telegram updating means 211 outputs the signaling telegram to the point communication section 23. If the member consists of only this point, the system goes back to step 1 and updating of the signaling telegram continues inside the signaling telegram updating means 211 until the addition request telegram from the train protection apparatus is inputted.

Figure 30:
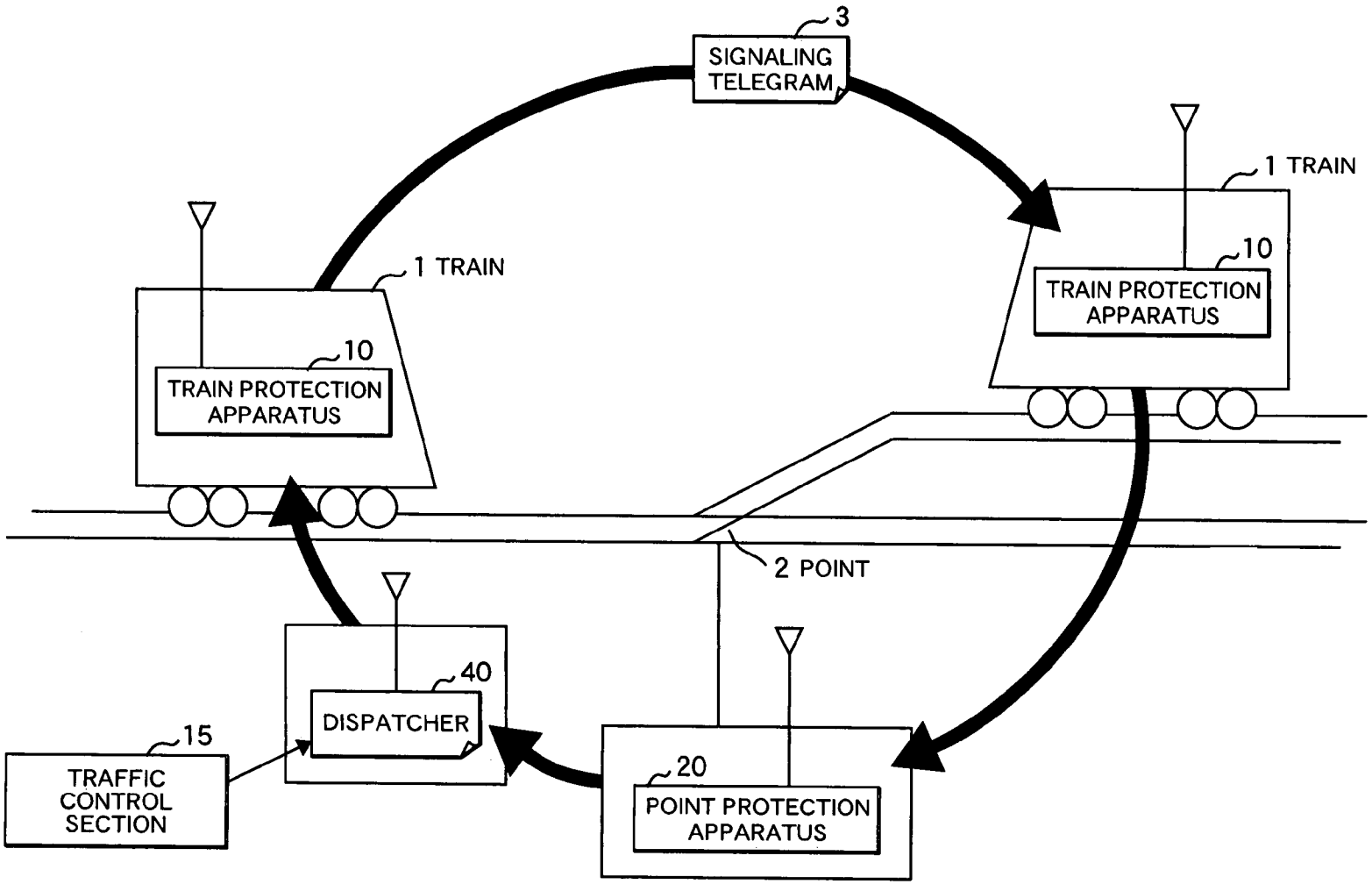
FIG. 30 is a diagram representing another embodiment of a signaling system in the present invention.

Referring to FIG. 30, the following describes another embodiment of the signaling system of the present invention.

The train, point and signaling telegram described in the present embodiment are the same as those described in the aforementioned embodiment, except that a dispatcher is included in the members to be patrolled by the signaling telegram.

The dispatcher 40 is provided with:

a communication means capable of communication with the train protection apparatus 10 and point protection apparatus 20;

a means for receiving operation planning information for each train from the traffic control section 15;

a means for getting the right of occupying the block in the route to be used for traveling, for each train when other trains have no right of block occupancy, based on the aforementioned operating planning information for each train and the block occupancy information of the signaling telegram 3 having been received; and a means for giving a lock position instruction to the point located in the block the right of occupying which has been obtained.

The dispatcher 40 has its inherent identification data and is included in the member list of the signaling telegram 3. To be more specific, it is a system that ensures safety by the patrol of signaling telegram, similarly to the cases of other trains and points.

For example, when the train operation planning information must be changed due to an accident or car trouble, such a system allows the operation to be performed according to the updated operation plan, if the dispatcher 40 is notified of the train operation planning information by a wayside control apparatus, without having to notify the train of the change in the operation planning information.

Figure 31:
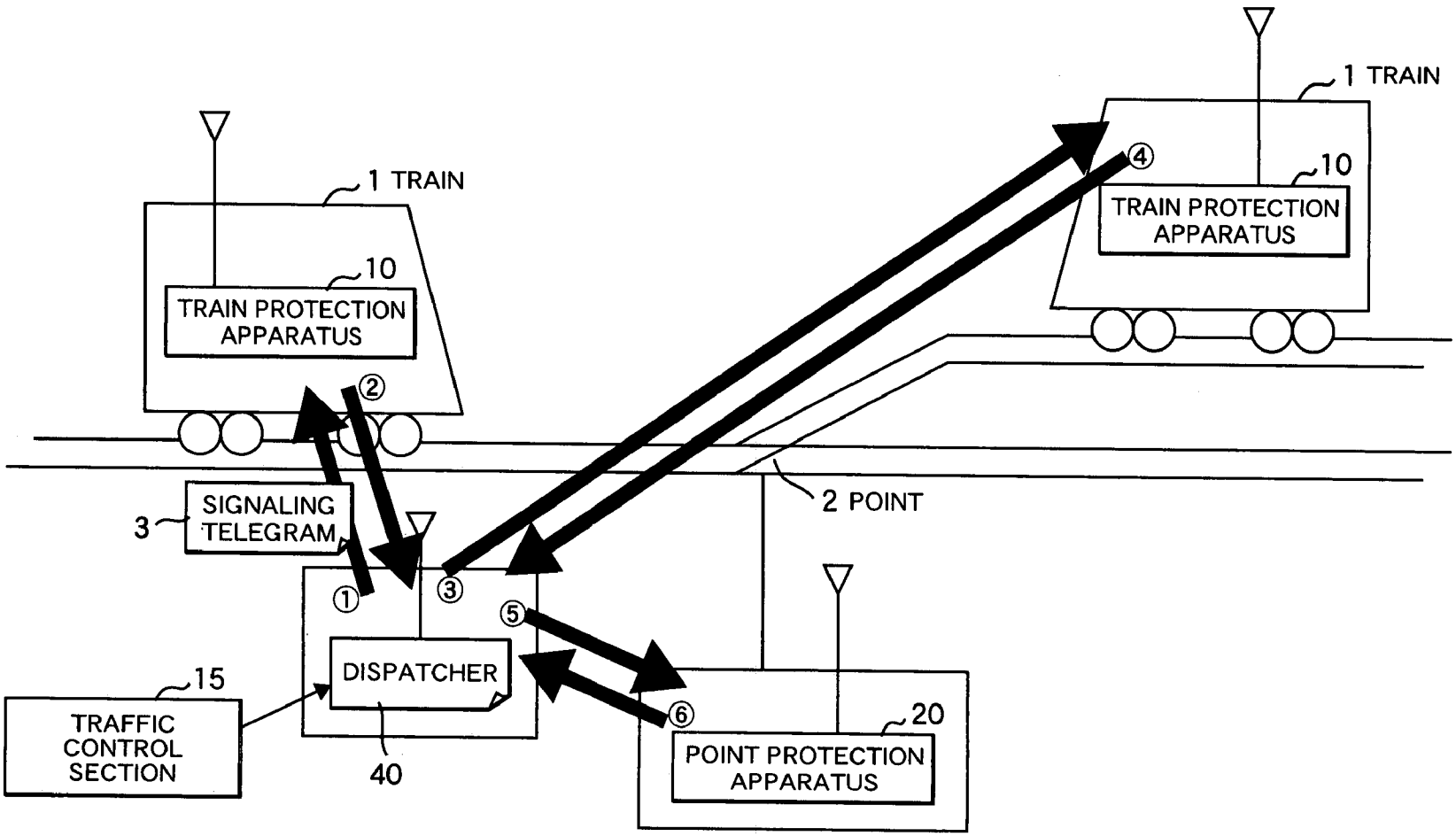
FIG. 31 is a diagram representing a further embodiment of a signaling system in the present invention.

Referring to FIG. 31, the following describes the signaling system using the same dispatcher as that shown in FIG. 30. This system is as a further embodiment which is different in the method of exchanging a signaling telegram with the dispatcher and other protection apparatuses.

The dispatcher 40 exchanges a signaling telegram with the train protection apparatus 10 and point protection apparatus 20. In this case, even when the train protection apparatus 10 or point protection apparatus 20 has been broken, earlier detection of the trouble can be achieved because the signaling telegram is always exchanged through the dispatcher 40.

The dispatcher 40 has the same structure as that explained above with reference to FIG. 30.

As described above, in order to ensure exchange of signaling telegrams between the dispatcher 40 and protection apparatuses, if the first item in the member list of the signaling telegram is the identification data of a train 1, the dispatcher 4 must be used as an intermediary even if the signaling telegram is to be sent to the point 2. To meet this requirement, the identification data of the dispatcher 40 is described as a second item in the member list and the identification data of the point 2 is described as a third item.

As described above, a change in the order in the member list ensures the signaling telegram to be exchanged with protection apparatuses at all times through the intermediary of the dispatcher 40, as in the present embodiment. Similarly to the case of the embodiment shown in FIG. 1, the aforementioned arrangement provides a signaling system characterized by reduced designing and manufacturing costs, and ensures earlier detection of a fault in the protection apparatuses.

As described above, the signaling system according to the present invention provides such an arrangement that a signaling telegram containing the information on the possessor of the right of block occupancy, lock position instruction to be given to the point and the position status of the point will patrol the protection apparatuses installed in a train and those installed on the point. Upon receipt of the signaling telegram, the train checks the block which other trains has the right of occupying, and the position status of the point, and updates the signaling telegram, whereby the right of occupying the block which other trains has not right of occupying can be obtained and the lock position instruction can be given to the point. Upon receipt of the signaling telegram, the point controls the lock position of the point and updates the signaling telegram. This procedure allows the position status of the point to be notified. Thus, the signaling system according to the present invention ensures safe operation of the train.

The aforementioned signaling system can be applied not only to railway cars, but also to automobiles traveling along predetermined routes. For example, a signaling telegram can be used to patrol the vehicles traveling on the superhighway, thereby ensuring traffic safety. Further, a signaling telegram is used to patrol vehicles running along predetermined routes in an amusement part and park so that traffic safety can be ensured. It is also possible to make such arrangements as to actuate emergency stop of a vehicle applied in an interrupt mode to the brake of a driver or operator.

What is claimed is:

1. A signaling system for ensuring protection of a train traveling within a predetermined section by only one signaling telegram; said system being configured such that said one signaling telegram patrols trains which are within said predetermined section and points located within said predetermined section, and contains lock position instruction information for the points and block occupancy information that assigns the right of occupied in one area by a train to each of blocks formed in multiple numbers by division of said predetermined section and point position status information;

the block occupancy information which is included in said only one signaling telegram is configured to be updated only in the train in which said only one signaling telegram is patrolling, the point position status information which is included in said only one signaling telegram being able to be updated only in the point in which said only one signaling telegram is patrolling;

the signaling system configured to be operatively associated with the train so that when the train is going to enter the next block, the train checks said only one signaling telegram having been received for the information on the right of block occupancy, and the train cannot enter the next block if another train holds the right of block occupancy;

a train configured to identify the state of occupancy of the block to be entered by checking the information on the right of occupancy of the block to be entered described in the received only one signaling telegram, and, if another train has not yet secured the right of block occupancy, the identification data of the former train is added to the information on the right of occupancy of the block corresponding to the one to be entered, whereby the right of block occupancy is ensured; and when said train has departed the block, the train is configured to erase the identification data thereof from the information on the right of occupancy of the block corresponding to the one from which the train has departed upon receipt of said only one signaling telegram; and the signaling system configured to be operatively associated with the point so that when the point switches over the lock position, the point describes current position in the point lock position information of said only one signaling telegram;

thereby exclusively controlling the right of block occupancy and the lock position status for the points in the one area by said only one signaling telegram.

2. The signaling system described in claim 1, further comprising:

a traffic control section for storing the operation planning information of a train and for generating the route request information for requesting permission for the train to enter the route, based on the operation planning information;

a train protection section capable of generating said one signaling telegram for determining, whether or not permission to enter should be granted to said train, and exchanging said one signaling telegram with other trains or wayside equipment; and a speed control section for controlling the train travel;

wherein said one signaling telegram patrols a train and wayside equipment located within a predetermined section and within the section adjacent thereto; and contains:

block occupancy information that for assigning the right of being occupied by a train to each of the blocks formed of a plurality of divisions of said section; and member list information represented in the order of patrol of the identification information of the train and wayside equipment;

wherein, based on the route request information from the traffic control section and the telegram received from another train or wayside equipment, said train protection section determines whether or not permission to enter should be granted to said train, sends the updated telegram with another train or wayside equipment, and outputs the result of decision to said train control section.

3. The signaling system described in claim 1, wherein, when said train enters a certain section based on the operation planning information of said traffic control section, said train protection section generates addition request information for adding the train thereof to the member list information in said one signaling telegram, and sends in addition request telegram to another train or wayside equipment holding the telegram in the section.

4. The signaling system described in claim 1, wherein said train protection section comprises:

a train communication section for exchanging said telegram with another train or wayside equipment;

a train input/output section in which the route request information is inputted from the traffic control section, and from which the result of decision on whether or not the permission to enter should be granted to said train is outputted to speed control section;

a train position detector for detecting the position of the train and for outputting the position information; and a train protection logic section for updating the telegram and determining whether or not the permission to enter should be granted to said train, based on said route request information inputted from the train input/output section, said telegram inputted from the train communication section, and said position information inputted from the train position detector.

5. The signaling system described in claim 1, further comprising a train position detector having:

information on the position of a route on which the train runs;

information in the block where the train travels; and information of train wheel diameter.

6. The signaling system described in claim 1, wherein said one signaling telegram has a member list information represented in the order of patrolling of the identification information of the train and wayside equipment.

7. The signaling system described in claim 1, wherein said one signaling telegram patrols the train or wayside equipment located within said predetermined section, and the train going to enter said predetermined section.

8. The signaling system described in claim 1, wherein said block can be occupied by only one train.

9. The signaling system described in claim 1, wherein said one signaling telegram includes communication control information for denoting a receiving end and a sending end.

10. The signaling system described in claim 6, wherein said wayside equipment is a point, and said one signaling telegram contains:

the lock position instruction information including such instruction information that the train having the right of occupying the block where the point is located instructs the lock position of the point; and the point position information including the information on the position of the point.

11. The signaling system described in claim 1, wherein, when a train is going to enter a section, the train sends to another train or wayside equipment holding a telegram in said section an addition request telegram for allowing said train to be added to a member list of said telegram.

12. The signaling system described in claim 1, wherein, if a point is present in the block which said train has the right of occupying, the train adds an intended lock position to the lock position instruction information of said point in said one signaling telegram, thereby notifying the point of the lock position.

13. The signaling system described in claim 1, wherein said equipment is a point, and, upon receipt of said one signaling telegram, said point is switched over to the lock position specified by the point position information of said one signaling telegram; the current position is described in the point lock position information of the telegram; and said one signaling telegram is sent to the next counterpart described in member list information of said telegram.

* * * * *